US008235099B2

(12) United States Patent
Higashiyama

(10) Patent No.: US 8,235,099 B2
(45) Date of Patent: Aug. 7, 2012

(54) HEAT EXCHANGER

(75) Inventor: Naohisa Higashiyama, Oyama (JP)

(73) Assignee: Showa Denko K.K., Tokyo (JP)

( * ) Notice: Subject to any disclaimer, the term of this patent is extended or adjusted under 35 U.S.C. 154(b) by 1106 days.

(21) Appl. No.: 12/153,993

(22) Filed: May 28, 2008

(65) Prior Publication Data

US 2008/0296003 A1 Dec. 4, 2008

(30) Foreign Application Priority Data

May 29, 2007 (JP) ..... 2007-142132

(51) Int. Cl.
*F28F 9/22* (2006.01)

(52) U.S. Cl. ..... 165/174

(58) Field of Classification Search ..... 165/174, 165/176; 62/525
See application file for complete search history.

(56) References Cited

U.S. PATENT DOCUMENTS

| | | | | |
|---|---|---|---|---|
| 1,893,270 | A * | 1/1933 | Caldwell | 165/146 |
| 2,611,584 | A * | 9/1952 | Labus | 165/151 |
| 6,161,616 | A * | 12/2000 | Haussmann | 165/176 |
| 6,729,386 | B1 * | 5/2004 | Sather | 165/110 |
| 7,086,249 | B2 * | 8/2006 | Bae et al. | 62/504 |
| 2005/0236148 | A1 * | 10/2005 | Higashiyama | 165/153 |
| 2006/0201198 | A1 * | 9/2006 | Nishino et al. | 62/525 |
| 2010/0089559 | A1 * | 4/2010 | Gorbounov et al. | 165/174 |

FOREIGN PATENT DOCUMENTS

| | | | |
|---|---|---|---|
| JP | 07149135 | A * | 6/1995 |
| JP | 11-351787 | A | 12/1999 |
| JP | 2002-107093 | A | 4/2002 |
| JP | 2006-132920 | | 5/2006 |
| JP | 2006132920 | A | 5/2006 |
| WO | WO 2006059783 | A1 * | 6/2006 |

OTHER PUBLICATIONS

Office Action for Japanese Patent Application No. 2007-142132 issued Dec. 13, 2011.

* cited by examiner

*Primary Examiner* — Allen Flanigan
(74) *Attorney, Agent, or Firm* — Edwards Wildman Palmer LLP

(57) ABSTRACT

A heat exchanger used as an evaporator includes a refrigerant inlet header section having a refrigerant inlet at a right end portion, and a plurality of heat exchange tubes connected to the refrigerant inlet header section. The interior of the refrigerant inlet header section is divided by a partition plate into an upper space into which refrigerant flows via the refrigerant inlet and a lower space into which the heat exchange tubes project. A communication opening is formed in the partition plate on the left side of a heat exchange tube at the left end so as to establish communication between the upper and lower spaces. A guide portion is formed at a left edge portion of the communication opening such that the guide portion projects from a lower surface of the partition member into the lower space so as to guide the refrigerant toward the right end side.

8 Claims, 14 Drawing Sheets

HEAT EXCHANGER

BACKGROUND OF THE INVENTION

The present invention relates to a heat exchanger preferably used as an evaporator of a car air conditioner, which is a refrigeration cycle to be mounted on, for example, an automobile.

Herein and in the appended claims, the upper and lower sides of FIGS. 1 and 2 will be referred to as "upper" and "lower," respectively.

The applicant of the present application has proposed a heat exchanger used as an evaporator for a car air conditioner which satisfies the needs of reducing size and weight and enhancing performance (see Japanese Patent Application Laid-Open (kokai) No. 2006-132920). The heat exchanger includes a heat exchange core section in which heat exchange tube groups are arranged in two rows in a front-rear direction, each heat exchange tube group consisting of a plurality of heat exchange tubes arranged at intervals; a refrigerant inlet/outlet header tank disposed on an upper-end side of the heat exchange core section; and a refrigerant turn header tank disposed on a lower-end side of the heat exchange core section. A refrigerant inlet header section and a refrigerant outlet header section are integrally provided and arranged side by side in the front-rear direction within the refrigerant inlet/outlet header tank. The refrigerant inlet header section has a refrigerant inlet at a first end, and is closed at a second end opposite the first end. The refrigerant outlet header section has a refrigerant outlet at a first end corresponding to the refrigerant inlet, and is closed at a second end opposite the first end. A first intermediate header section, which faces the refrigerant inlet header section, and a second intermediate header section, which faces the refrigerant outlet header section, are integrally provided and arranged side by side in the front-rear direction within the refrigerant turn header tank. Upper end portions of the heat exchange tubes of a front heat exchange tube group are connected to the refrigerant inlet header section, and upper end portions of the heat exchange tubes of a rear heat exchange tube group are connected to the refrigerant outlet header section. Lower end portions of the heat exchange tubes of the front heat exchange tube group are connected to the first intermediate header section, and lower end portions of the heat exchange tubes of the rear heat exchange tube group are connected to the second intermediate header section. The interior of the refrigerant inlet header section is divided into two spaces; specifically, upper and lower spaces, by means of a plate-shaped partition member. Refrigerant flows into the first (upper) space via the refrigerant inlet, and the heat exchange tubes project into the second (lower) space. The partition member has a communication opening which is formed at a location between the second end opposite the refrigerant inlet and a heat exchange tube closest to the second end so as to establish communication between the first and second spaces. Thus, the refrigerant is caused to flow from the first space into the second space via the communication opening while changing its flow direction to make a U-turn.

However, as a result of various studies, the present inventor has found that the evaporator described in the above-described publication has the following problems.

That is, especially in a case where the amount of refrigerant is large, when the refrigerant flows from the first space to the second space of the refrigerant inlet header section via the communication opening, due to the force of the flow, the refrigerant hits against a portion of a wall of the refrigerant inlet header section to which the heat exchange tubes are connected, the portion being generally located just under the communication opening, and changes its flow direction toward the partition member, so that the refrigerant encounters difficulty in flowing into several heat exchange tubes which are located at an end portion opposite the refrigerant inlet. As a result, outflow air temperature, which is the temperature of air having passed through the evaporator, becomes slightly non-uniform at the end portion opposite the refrigerant inlet, and in some cases the degree of uniformity of the outflow air temperature becomes insufficient.

SUMMARY OF THE INVENTION

An object of the present invention is to solve the above problem and to provide a heat exchanger which, when used as an evaporator, can make the outflow air temperature more uniform.

To achieve the above object, the present invention comprises the following modes.

1) A heat exchanger comprising a refrigerant inlet header section having a refrigerant inlet at a first end and closed at a second end opposite the first end; and a plurality of heat exchange tubes disposed at predetermined intervals along the longitudinal direction of the refrigerant inlet header section and connected to the refrigerant inlet header section, in which the interior of the refrigerant inlet header section is divided vertically into first and second spaces by means of a partition member, refrigerant flows into the first space via the refrigerant inlet, the heat exchange tubes project into the second space, the partition member has a communication opening located on the side toward the second end with respect to a heat exchange tube provided at an end portion of the partition member opposite the refrigerant inlet, the communication opening establishing communication between the first and second spaces, to thereby cause the refrigerant to flow from the first space into the second space via the communication opening while changing its flow direction to make a U-turn, wherein a guide portion is provided at an edge portion of the communication opening on the second end side, the guide portion projecting into the second space from a surface of the partition member facing the second space, and guiding the refrigerant to flow toward the first end side.

2) A heat exchanger according to par. 1), wherein the guide portion includes a slant portion which inclines toward the heat exchange tubes while approaching the first end, and a horizontal portion extending from a distal end of the slant portion toward the first end.

3) A heat exchanger according to par. 2), wherein the distal end of the horizontal portion of the guide portion is located on the side toward the first end with respect to a first-end-side edge portion of the communication opening.

4) A heat exchanger according to par. 2 or 3), wherein the guide portion includes connection portions which are formed integrally with the partition member at opposite edge portions of the communication opening with respect to a direction of air flow such that the connection portions inline downward toward the inner side with respect to the direction of air flow, the connection portions connecting opposite edge portions, with respect to the direction of air flow, of the slant portion and the horizontal portion to the partition member.

5) A heat exchanger according to par. 1), wherein the guide portion includes a slant portion which inclines toward the heat exchange tubes while approaching the first end.

6) A heat exchanger according to par. 5), wherein the guide portion includes connection portions which are formed integrally with the partition member at opposite edge portions of the communication opening with respect to a direction of air flow such that the connection portions inline downward toward the inner side with respect to the direction of air flow, the connection portions connecting opposite edge portions, with respect to the direction of air flow, of the slant portion to the partition member.

7) A heat exchanger according to par. 1), wherein the guide portion includes a curved portion which curves toward the heat exchange tubes while approaching the first end.

8) A heat exchanger according to par. 7), wherein the curved portion of the guide portion assumes an arcuate shape, when viewed from the refrigerant inlet side, such that a central portion with respect to the direction of air flow projects toward the heat exchange tubes, and opposite edge portions of the curved portion with respect to the direction of air flow are connected to opposite edge portions, with respect to the direction of air flow, of the communication opening of the partition member.

9) A heat exchanger according to par. 1), wherein the refrigerant inlet header section includes an inlet-header-section main body which is opened at opposite ends thereof, and first and second caps which close the opened opposite ends of the inlet-header-section main body; the inlet-header-section main body includes a first member to which the heat exchange tubes are connected, and a second member joined to the first member and covering a side of the first member opposite the heat exchange tubes; a plate-shaped partition member is disposed between the first and second members and joined to the first and second members; and the refrigerant inlet is formed in a portion of the first cap on the first end side, the portion being located above the partition member.

10) A heat exchanger according to par. 9), wherein each of the caps has a first inward projecting portion to be fitted into the first space of the inlet-header-section main body and a second inward projecting portion to be fitted into the second space of the inlet-header-section main body; the refrigerant inlet is formed in a projecting end wall of the first inward projecting portion of the first cap; and opposite end portions of the plate-shaped partition member are fitted between the first and second inward projecting portions of the first and second caps and joined to the first and second caps.

11) A heat exchanger according to par. 9) or 10), wherein a refrigerant outlet header section is integrally provided on the upstream side of the refrigerant inlet header section with respect to the direction of air flow; the refrigerant outlet header section includes an outlet-header-section main body which is opened at opposite ends thereof, and first and second caps which close the opened opposite ends of the outlet-header-section main body; the outlet-header-section main body includes a first member to which the heat exchange tubes are connected, a second member joined to the first member and covering a side of the first member opposite the heat exchange tubes, and a plate-shaped partition member which is disposed between the first and second members so as to vertically divide the interior of the refrigerant outlet header section into first and second spaces; the partition member has a communication hole which establishes communication between the first and second spaces; the first member, the second member, and the plate-shaped partition member of the outlet-header-section main body are integrated with the first member, the second member, and the plate-shaped partition member of the inlet-header-section main body; the first and second caps of the refrigerant inlet header section are respectively integrated with the first and second caps of the refrigerant outlet header section; and the refrigerant inlet header section and the refrigerant outlet header section form a refrigerant inlet/outlet header tank.

12) A heat exchanger according to par. 11), wherein a refrigerant turn header tank is disposed such that the refrigerant turn header tank is separated from the refrigerant inlet/outlet header tank; a first intermediate header section facing the refrigerant inlet header section and a second header section facing the refrigerant outlet header section and communicating with the first intermediate header section are integrally provided in the refrigerant turn header tank; at least two heat exchange tube groups each composed of a plurality of heat exchange tubes whose opposite end portions are connected to the respective header sections of the two header tanks are arranged at an interval in the direction of air flow such that at least one heat exchange tube group is disposed between each header section of one header tank and the corresponding header section of the other header tank; the refrigerant turn header tank includes a first member to which the heat exchange tubes are connected, a second member joined to the first member and covering a side of the first member opposite the heat exchange tubes, and a plate-shaped partition member which is disposed between the first and second members and joined to the first and second members so as to vertically divide the interiors of the first and second intermediate header sections into respective first and second spaces; and the plate-shaped partition member has communication holes which establish communication between the first and second spaces of the first intermediate header section and communication between the first and second spaces of the second intermediate header section.

According to the heat exchangers of pars. 1) to 8), the partition member has a guide portion at an edge portion of the communication opening on the second end side, the guide portion projecting into the second space from a surface of the partition member facing the second space, and guiding the refrigerant to flow toward the first end side. Therefore, even in the case where the amount of refrigerant is large, when the refrigerant flows from the first space into the second space of the refrigerant inlet header section via the communication opening, the refrigerant is guided by the guide portion to smoothly flow toward the first end side; i.e., the end where the refrigerant inlet is formed. Accordingly, the refrigerant is prevented from hitting, due to the flow force, against a portion of the wall of the refrigerant inlet header section to which the heat exchange tubes are connected, the portion corresponding to the communication opening, and changing its flow direction toward the partition member. As a result, the refrigerant becomes more likely to flow into several heat exchange tubes located at the end portion opposite the refrigerant inlet. Therefore, when the heat exchanger is used as an evaporator, the outflow air temperature, which is the temperature of air having passed through the evaporator, is made uniform at the end portion opposite the refrigerant inlet, and the degree of uniformity of the outflow air temperature can be increased.

According to the heat exchanger of par. 9), the guide portion can be formed relatively simply by performing press work or the like on a plate-shaped material.

According to the heat exchanger of par. 10), the reliability of the joint between the partition member and the caps can be improved. Further, the withstanding pressure of the caps themselves can be increased.

According to the heat exchanger of par. 11), a refrigerant inlet/outlet header tank having a refrigerant inlet header section and a refrigerant outlet header section can be manufactured relatively easily.

According to the heat exchanger of par. 12), members identical with the first and second members of the refrigerant inlet/outlet header tank can be used as the first and second members of the refrigerant turn header tank, whereby the number of parts can be reduced.

DESCRIPTION OF THE PREFERRED EMBODIMENT

Figure 1:
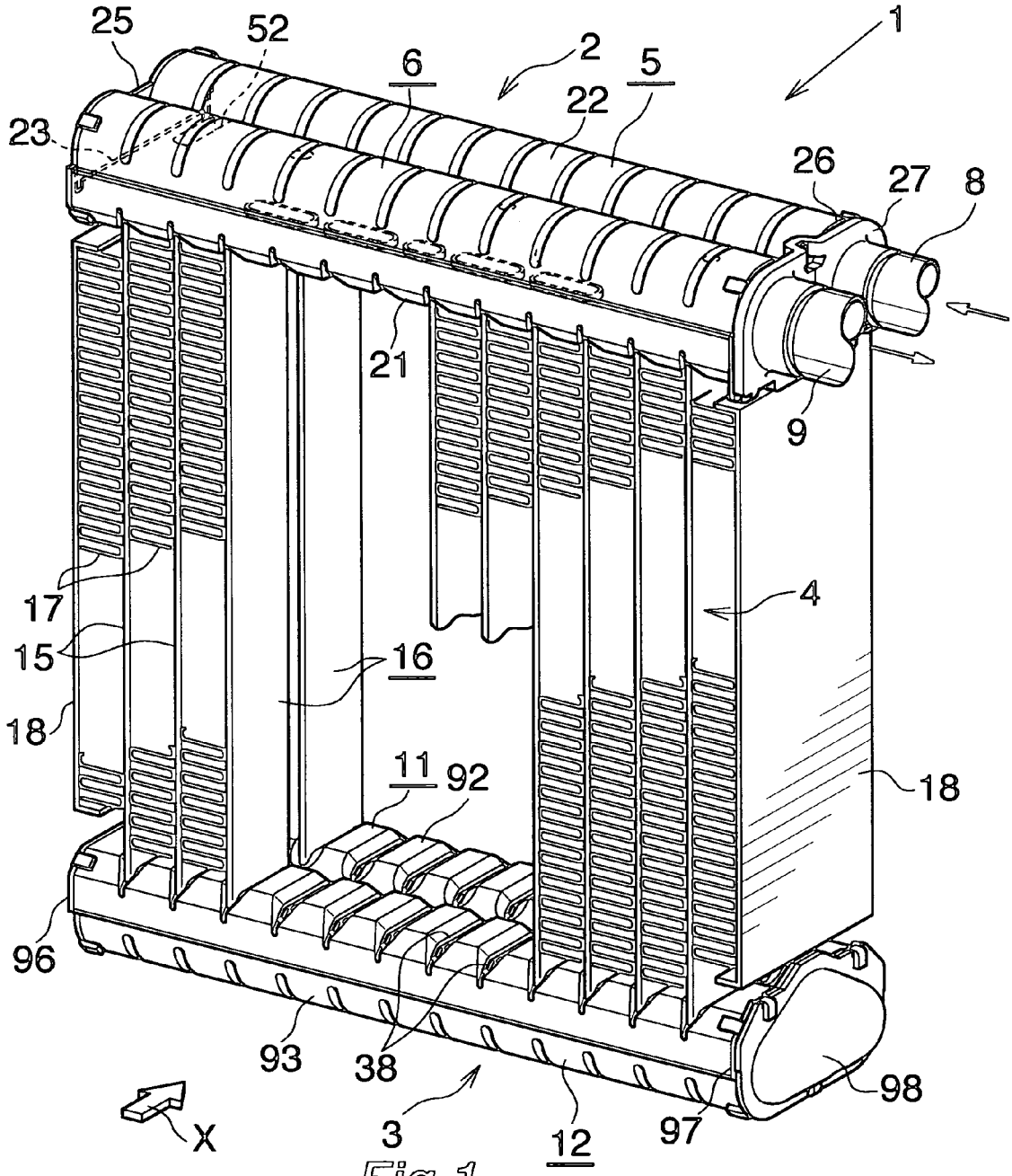
FIG. 1 is a partially cut-away perspective view showing the overall configuration of an evaporator to which a heat exchanger according to the present invention is applied.

A preferred embodiment of the present invention will next be described with reference to the drawings. The embodiment is of a heat exchanger according to the present invention that is applied to an evaporator of a car air conditioner using a chlorofluorocarbon-based refrigerant.

In the following description, the term "aluminum" includes aluminum alloys in addition to pure aluminum. Also, in the following description, the downstream side (a direction represented by arrow X in FIGS. 1, 3, and 4) of an air flow through air-passing clearances between adjacent heat exchange tubes will be referred to as the "front," and the opposite side as the "rear." The left-hand and right-hand sides of FIG. 2 will be referred to as "left" and "right," respectively.

Further, the same reference numerals are used throughout the drawings to refer to the same portions and members, and their repeated descriptions are omitted.

Figure 2:
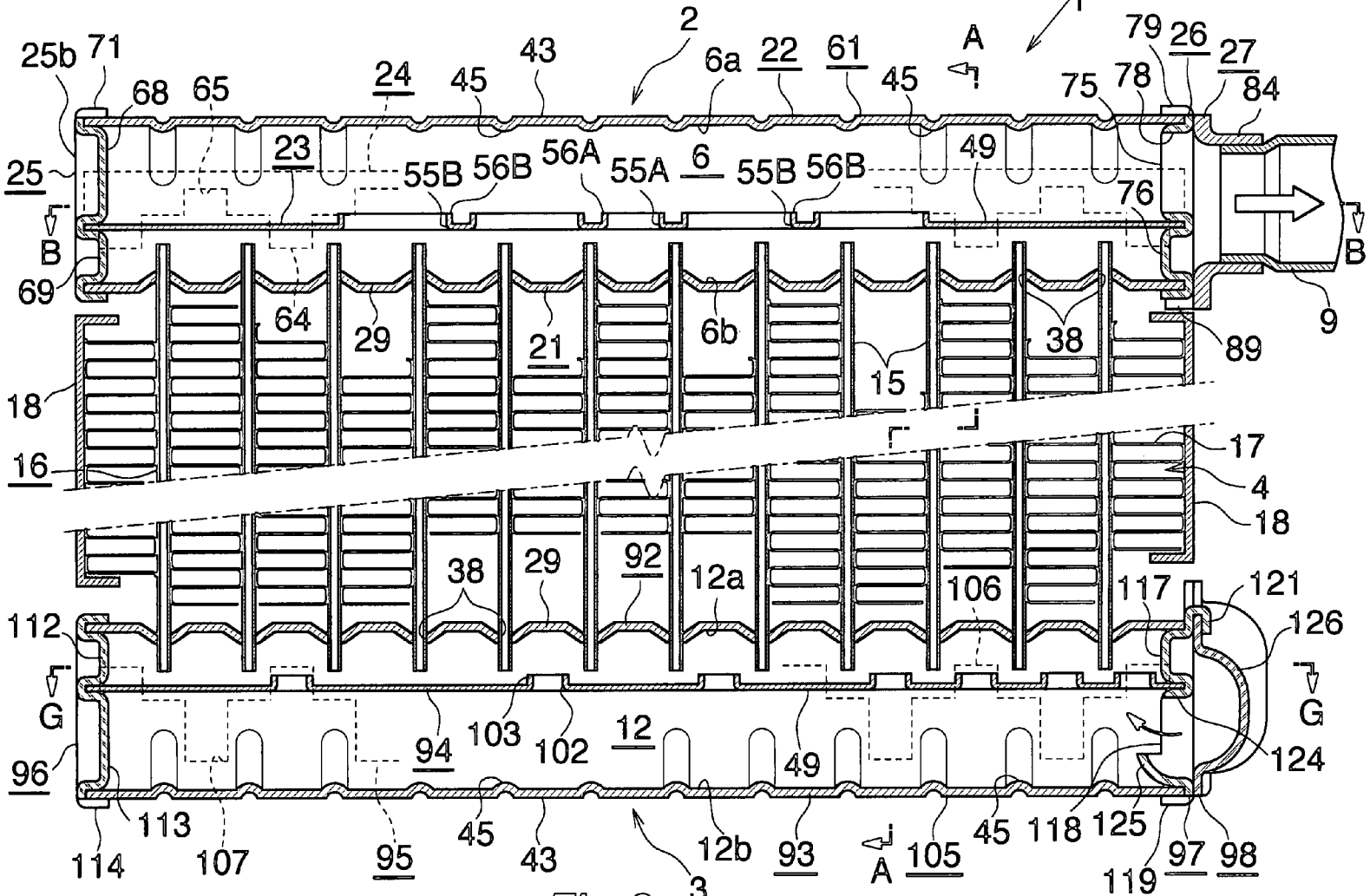
FIG. 2 is a vertical cross sectional view of the evaporator of FIG. 1 as it is seen from the rear, with its intermediate portion omitted.

FIGS. 1 and 2 show the overall configuration of an evaporator, and FIGS. 3 to 13 show the configuration of a main portion of the evaporator.

As shown in FIGS. 1 to 4, the evaporator (1) is configured such that a heat exchange core section (4) is provided between a refrigerant inlet/outlet header tank (2) made of aluminum and a refrigerant turn header tank (3) made of aluminum, which are separated from each other in the vertical direction.

Figure 3:
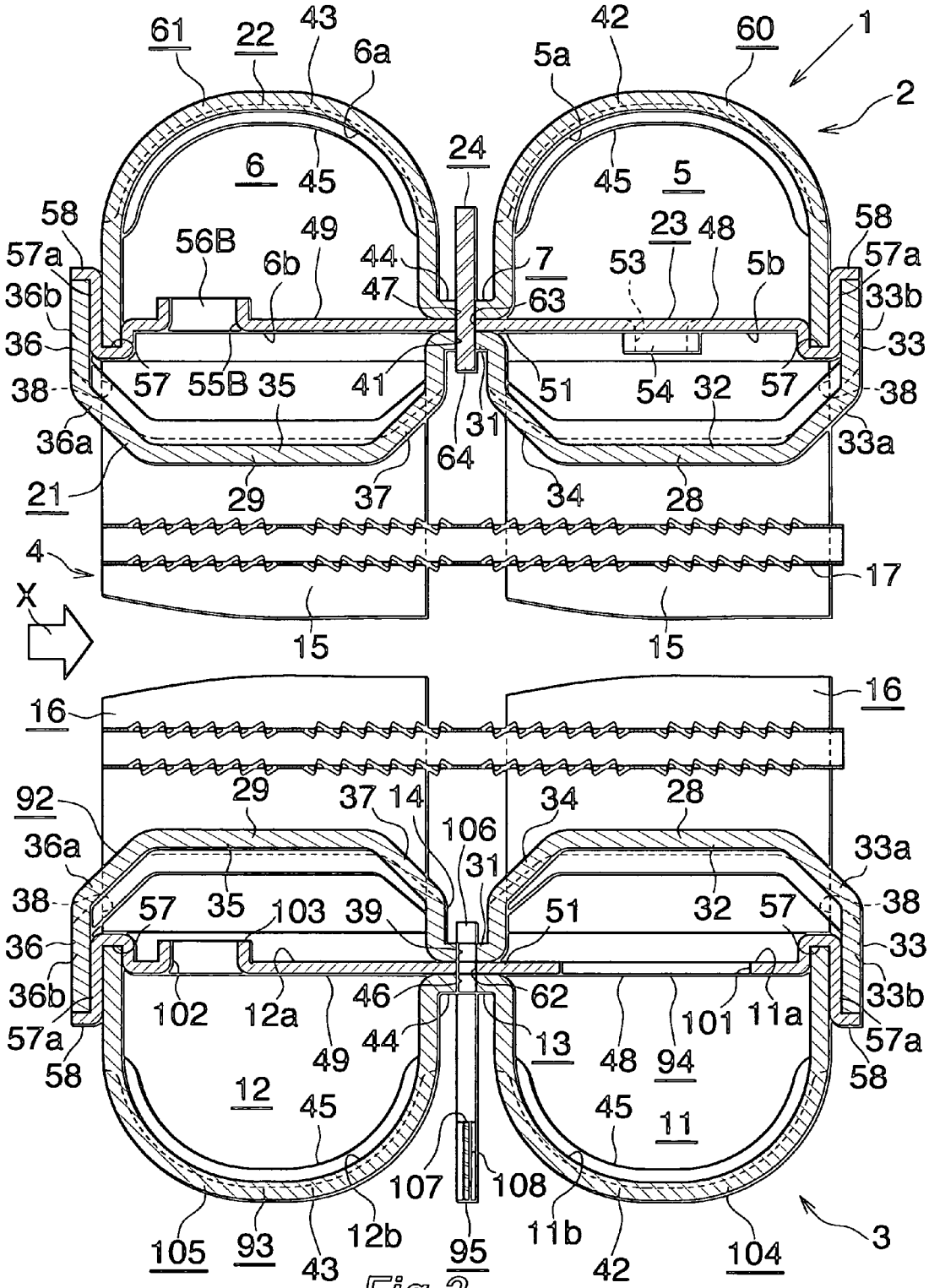
FIG. 3 is a partially-omitted, enlarged cross sectional view taken along line A-A of FIG. 2.
Figure 4:
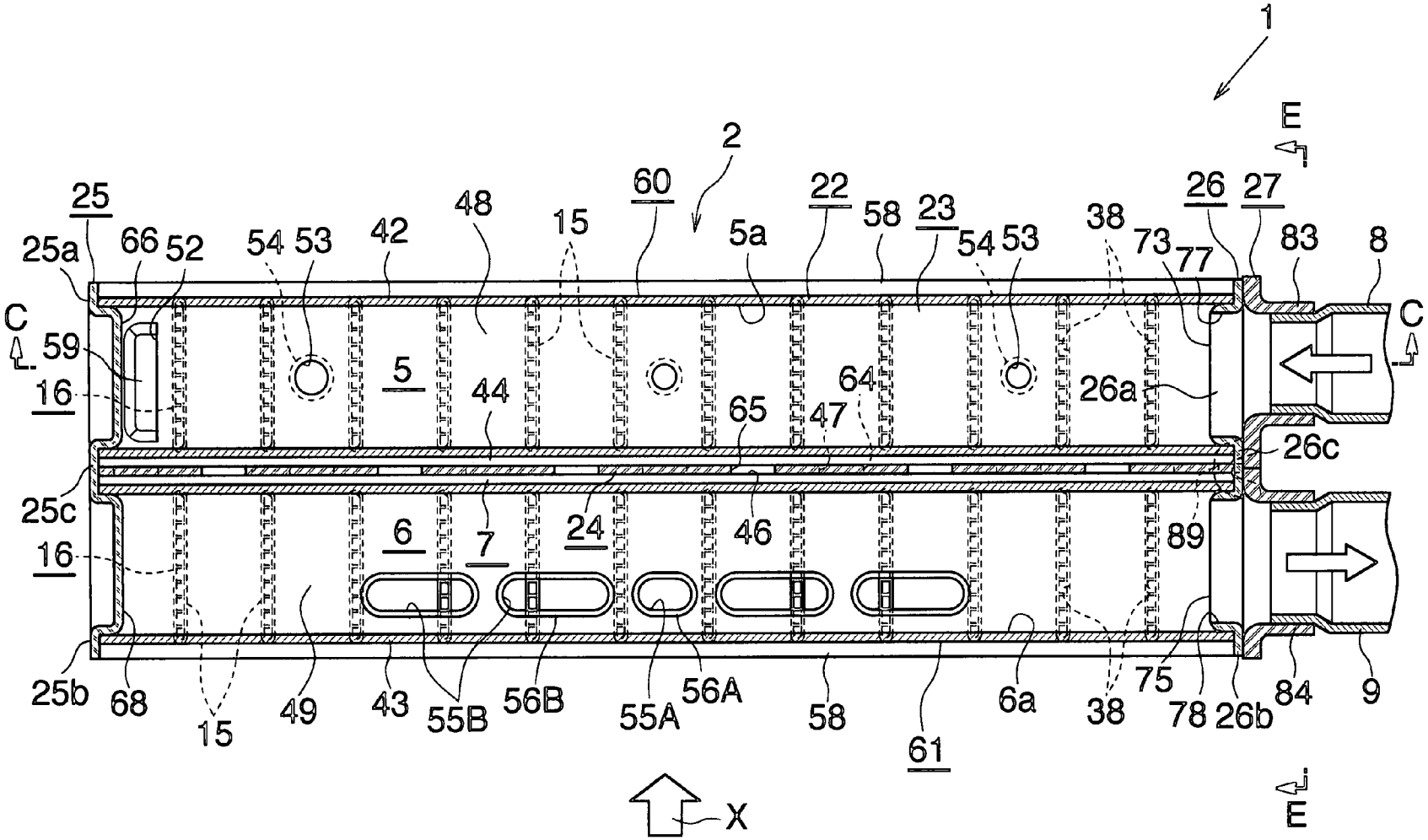
FIG. 4 is a cross sectional view taken along line B-B of FIG. 2.
Figure 5:
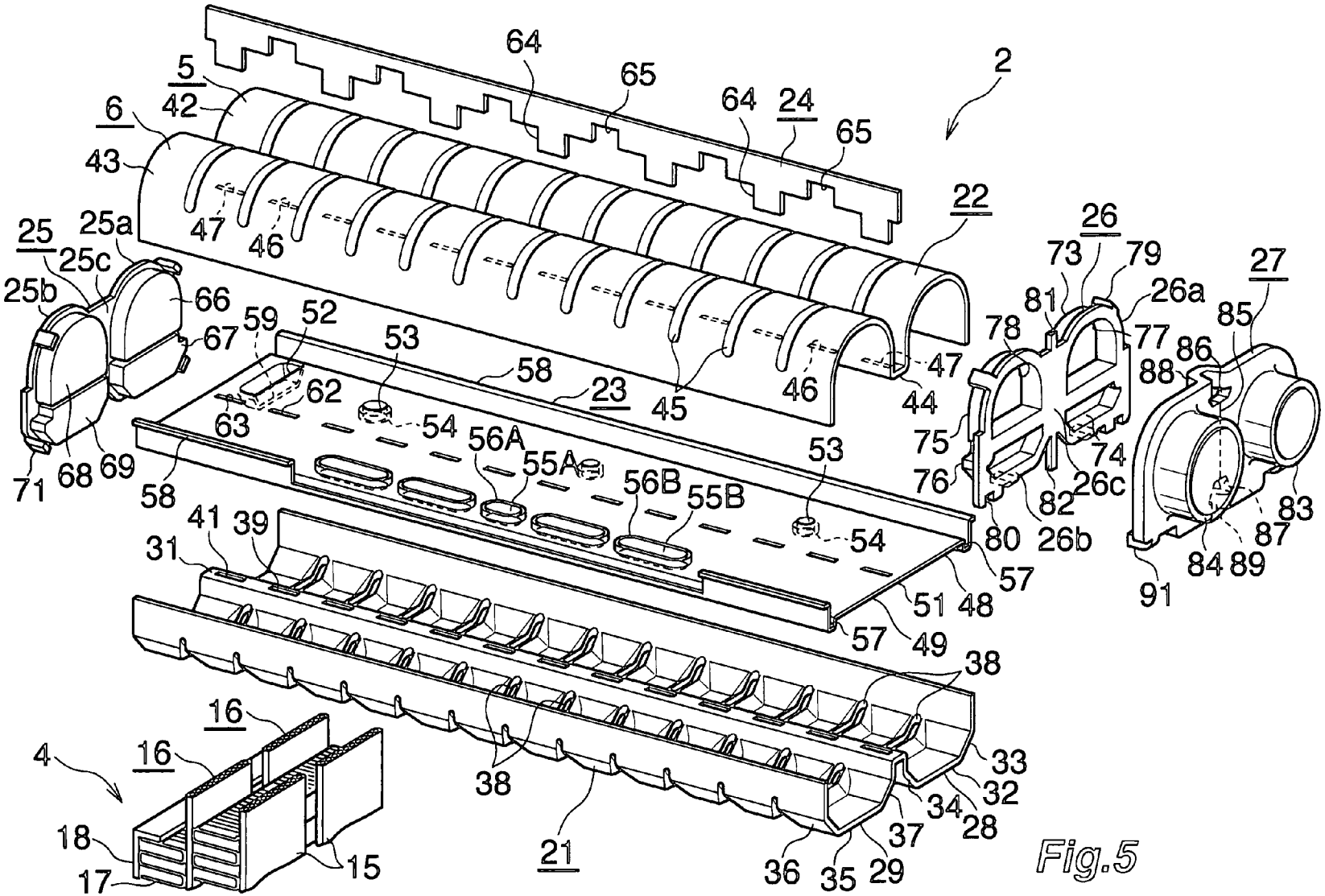
FIG. 5 is an exploded perspective view of a refrigerant inlet/outlet header tank of the evaporator shown in FIG. 1.
Figure 6:
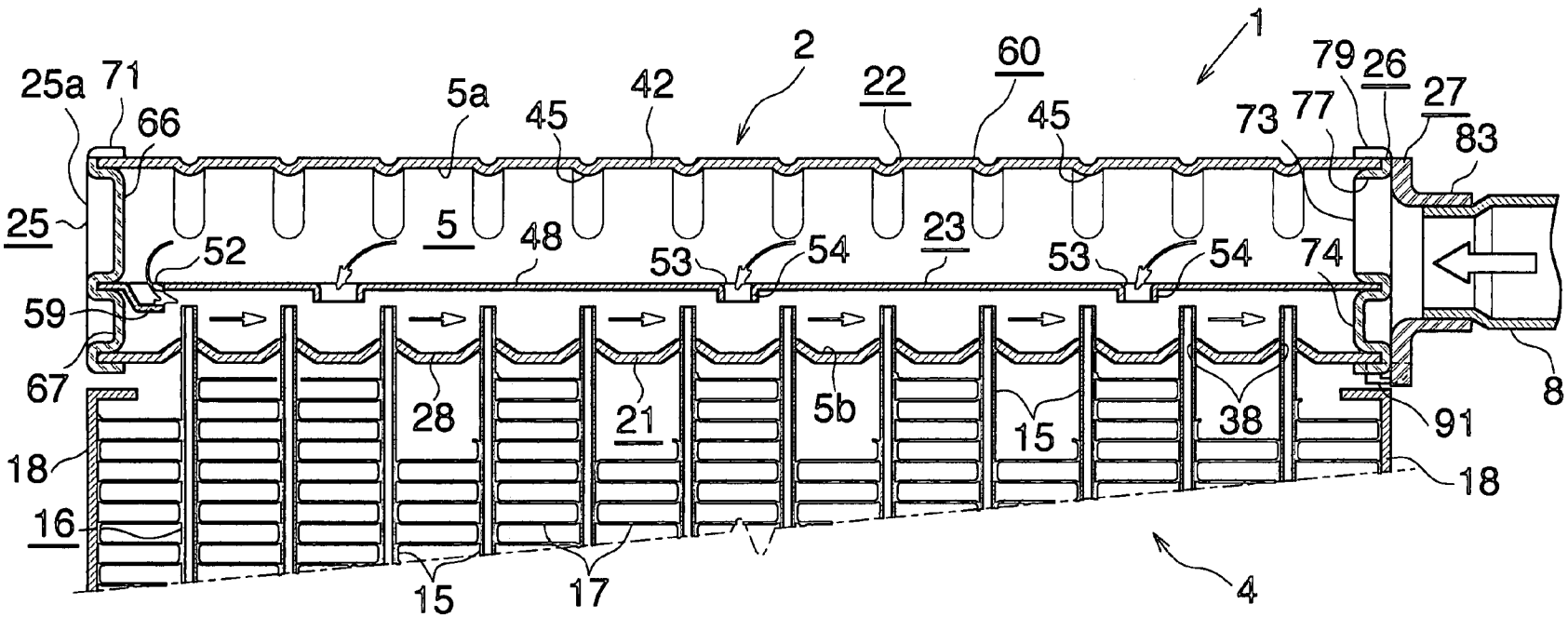
FIG. 6 is a partially-omitted cross sectional view taken along line C-C of FIG. 4.

The refrigerant inlet/outlet header tank (2) includes a refrigerant inlet header section (5) located on the front side (downstream side with respect to the air flow direction); a refrigerant outlet header section (6) located on the rear side (upstream side with respect to the air flow direction); and a connection portion (7) for mutually connecting the header sections (5) and (6) for integration (see FIG. 3). The refrigerant inlet header section (5) has a refrigerant inlet (77) at its right end, and is closed at its left end. The refrigerant outlet header section (6) has a refrigerant outlet (78) at its right end, and is closed at its left end. A refrigerant inlet pipe (8) made of aluminum is connected to the refrigerant inlet header section (5) of the refrigerant inlet/outlet header tank (2). A refrigerant outlet pipe (9) made of aluminum is connected to the refrigerant outlet header section (6) of the refrigerant inlet/outlet header tank (2).

The refrigerant turn header tank (3) includes a first intermediate header section (11) located on the front side; a second intermediate header section (12) located on the rear side; and a connection portion (13) for mutually connecting the header sections (11) and (12) for integration. The header sections (11) and (12) and the connection portion (13) form a drain trough (14) (see FIG. 3). The circumferential walls of the refrigerant inlet/outlet header tank (2) and the refrigerant turn header tank (3) have transverse cross sectional shapes which are identical with each other but are mirror images with respect to the vertical direction.

The heat exchange core section (4) is configured such that heat exchange tube groups (16) are arranged in a plurality of; herein, two, rows in the front-rear direction, each heat exchange tube group (16) consisting of a plurality of heat exchange tubes (15) arranged in parallel at predetermined intervals in the left-right direction. Corrugate fins (17) are disposed within air-passing clearances between the adjacent heat exchange tubes (15) of the heat exchange tube groups (16) and on the outer sides of the leftmost and rightmost heat exchange tubes (15) of the heat exchange tube groups (16), and are brazed to the corresponding heat exchange tubes (15). Side plates (18) made of aluminum are disposed on the outer sides of the leftmost and rightmost corrugate fins (17), and are brazed to the corresponding corrugate fins (17). The upper and lower ends of the heat exchange tubes (15) of the front heat exchange tube group (16) are connected to the refrigerant inlet header section (5) and the first intermediate header section (11), respectively. The upper and lower ends of the heat exchange tubes (15) of the rear heat exchange tube group (16) are connected to the refrigerant outlet header section (6) and the second intermediate header section (12), respectively. The refrigerant inlet header section (5) and the second intermediate header section (12) are header sections in which refrigerant flows into the heat exchange tubes (15).

Each of the heat exchange tubes (15) is formed from a bare aluminum extrudate, and assumes a flat form such that its width direction coincides with the front-rear direction. The heat exchange tube (15) has a plurality of refrigerant channels arranged in parallel in the width direction. Each of the corrugated fins (17) is made in a wavy form from an aluminum brazing sheet having a brazing material layer over opposite surfaces thereof. Each of the corrugate fins (17) includes wave crest portions, wave trough portions, and horizontal flat connection portions connecting the wave crest portions and the wave trough portions. A plurality of louvers are formed at the connection portions in such a manner as to be juxtaposed in the front-rear direction. The front and rear heat exchange tubes (15) that constitute the front and rear heat exchange tube groups (16) share the corrugate fins (17). The width of each corrugate fin (17) as measured in the front-rear direction is generally equal to the distance between the front edges of the front heat exchange tubes (15) and the rear edges of the rear heat exchange tubes (15). The wave crest portions and the wave trough portions of the corrugate fins (17) are brazed to the front and rear heat exchange tubes (15). The front edges of the corrugate fins (17) slightly project frontward from the front edges of the front heat exchange tubes (15). Notably, instead of a single corrugate fin being shared between the front and rear heat exchange tube groups (16), a corrugate fin may be disposed between the adjacent heat exchange tubes (15) of each of the front and rear heat exchange tube groups (16).

As shown in FIGS. 2 to 6, the refrigerant inlet/outlet header tank (2) is composed of a plate-like first member (21), a second member (22), a flat partition plate (23) (a plate-shaped partition member), a provisional fixing member (24), and aluminum end members (25) and (26). The first member (21) is formed through press working from an aluminum brazing sheet having a brazing material layer over opposite surfaces thereof. All the heat exchange tubes (15) are connected to the first member (21). The second member (22) is formed through press working from an aluminum brazing sheet having a brazing material layer over opposite surfaces thereof, and covers the upper side (the side opposite the heat exchange tubes (15)) of the first member (21). The partition plate (23) is formed through press working from an aluminum bare material or an aluminum brazing sheet having a brazing material layer over opposite surfaces thereof, and is disposed between the first member (21) and the second member (22) so as to divide the interiors of the refrigerant inlet header section (5) and the refrigerant outlet header section (6) into upper and lower spaces (5*a*) and (5*b*) and into upper and lower spaces (6*a*) and (6*b*), respectively. The provisional fixing member (24) is formed through press working from an aluminum bare material, and is used for provisionally fixing the first member (21), the second member (22), and the partition plate (23). The aluminum end members (25) and (26) are formed through press working from an aluminum brazing sheet having a brazing material layer over opposite surfaces thereof, and are brazed to the left and right ends of the first member (21), the second member (22), and the partition plate (23). A joint plate (27) made of aluminum and elongated in the front-rear direction is brazed to the outer surface of the right end member (26) while extending over the refrigerant inlet header section (5) and the refrigerant outlet header section (6). The refrigerant inlet pipe (8) and the refrigerant outlet pipe (9) are joined to the joint plate (27). Notably, the joint plate (27) is formed from an aluminum bare material through press working. In the present embodiment, the upper space (5*a*) of the interior of the refrigerant inlet header section (5) is a first space into which refrigerant flows, and the lower space (5*b*) thereof is a second space into which the heat exchange tubes (15) project.

The first member (21) includes a first header forming portion (28) (a first member of the refrigerant inlet header section (5)) which bulges downward and forms a lower portion of the refrigerant inlet header section (5); a second header forming portion (29) (a first member of the refrigerant outlet header section (6)) which bulges downward and forms a lower portion of the refrigerant outlet header section (6); and a connection wall (31) which connects a rear edge portion of the first header forming portion (28) and a front edge portion of the second header forming portion (29) and forms a lower portion of the connection portion (7). The first header forming portion (28) includes a horizontal flat bottom wall (32), and front and rear walls (33) and (34) integrally formed at the front and rear edge portions of the bottom wall (32). The front wall (33) includes a slant portion (33*a*) obliquely extending upward from the front edge of the bottom wall (32) toward the front side, and a vertical portion (33*b*) extending upward from the upper edge of the slant portion (33*a*). The rear wall (34) obliquely extends upward toward the rear side, and its upper end portion extends vertically. The upper end of the front wall (33) is located above that of the rear wall (34). The second header forming portion (29), which is a mirror image of the first header forming portion (28) with respect to the front-rear direction, includes a horizontal flat bottom wall (35), and rear and front walls (36) and (37) integrally formed at the rear and front edge portions of the bottom wall (35). The rear wall (36) includes a slant portion (36*a*) obliquely extending upward from the rear edge of the bottom wall (35) toward the rear side, and a vertical portion (36*b*) extending upward from the upper edge of the slant portion (36*a*). The front wall (37) obliquely extends upward toward the front side, and its upper end portion extends vertically. The upper end of the rear wall (36) is located above that of the front wall (37). The upper edge of the rear wall (34) of the first header forming portion (28) and the upper edge of the front wall (37) of the second header forming portion (29) are integrally connected by the connection wall (31).

A plurality of tube insertion holes (38), which are elongated in the front-rear direction, are formed in the two header forming sections (28) and (29) of the first member (21) at predetermined intervals in the left-right direction. The tube insertion holes (38) of the first header forming section (28) and those of the second header forming section (29) are identical in position in the left-right direction. The tube insertion holes (38) of the first header forming section (28) are formed to extend from the slant portion (33*a*) of the front wall (33) to the rear wall (34); and the tube insertion holes (38) of the second header forming section (29) are formed to extend from the slant portion (36*a*) of the rear wall (36) to the front wall (37). Upper end portions of the heat exchange tubes (15) of the front and rear heat exchange tube groups (16) of the heat exchange core section (4) are inserted into the tube insertion holes (38) of the header forming sections (28) and (29), and are brazed to the first member (21) by making use of the brazing material layer of the first member (21). Thus, the upper end portions of the heat exchange tubes (15) of the front heat exchange tube group (16) are connected to the refrigerant inlet header section (5) such that fluid communication is established therebetween; and the upper end portions of the heat exchange tubes (15) of the rear heat exchange tube group (16) are connected to the refrigerant outlet header section (6) such that fluid communication is established therebetween. A plurality of drain through holes (39), which are elongated in the left-right direction, are formed in the connection wall (31) of the first member (21) at predetermined intervals in the left-right direction. Further, a plurality of fixation through holes (41) are formed in the connection wall (31) of the first member (21) at predetermined intervals in the left-right direction such that the fixation through holes (41) are located at positions shifted from the positions of the drain through holes (39). In the present embodiment, the drain through holes (39) and the fixation through holes (41) are formed alternately.

The second member (22) includes a first header forming portion (42) (a second member of the refrigerant inlet header section (5)) which bulges upward and forms an upper portion of the refrigerant inlet header section (5); a second header forming portion (43) (a second member of the refrigerant outlet header section (6)) which bulges upward and forms an upper portion of the refrigerant outlet header section (6); and a connection wall (44) which connects a rear edge portion of the first header forming portion (42) and a front edge portion of the second header forming portion (43) and forms an upper portion of the connection portion (7). The first header forming portion (42) and the second header forming portion (43) have a generally U-shaped transversal cross section; i.e., they are opened downward, and their central portions in the front-rear direction project upward. Each of the header forming portions (42) and (43) has a plurality of inwardly projecting portions (45) at predetermined intervals in the longitudinal direction thereof. In each of the header forming portions (42) and (43), the inwardly projecting portions (45) extend from outer portions to inner portions of the header forming portion with respect to the front-rear direction. Further, drain through holes (46) are formed in the connection wall (44) at positions corresponding to the drain through holes (39) of the first member (21); and fixation through holes (47) are formed in the connection wall (44) at positions corresponding to the fixation through holes (41) of the first member (21).

The partition plate (23) includes a front partition portion (48) (a plate-shaped partition member of the refrigerant inlet header section (5)) which divides the interior of the refrigerant inlet header section (5) into the upper and lower spaces (5*a*) and (5*b*); a rear partition portion (49) (a plate-shaped partition member of the refrigerant outlet header section (6)) which divides the interior of the refrigerant outlet header section (6) into the upper and lower spaces (6*a*) and (6*b*); and a connection wall (51) which connects the front and rear partition portions (48) and (49), and is sandwiched between and brazed to the connection wall (31) of the first member (21) and the connection wall (44) of the second member (22).

Figure 7:
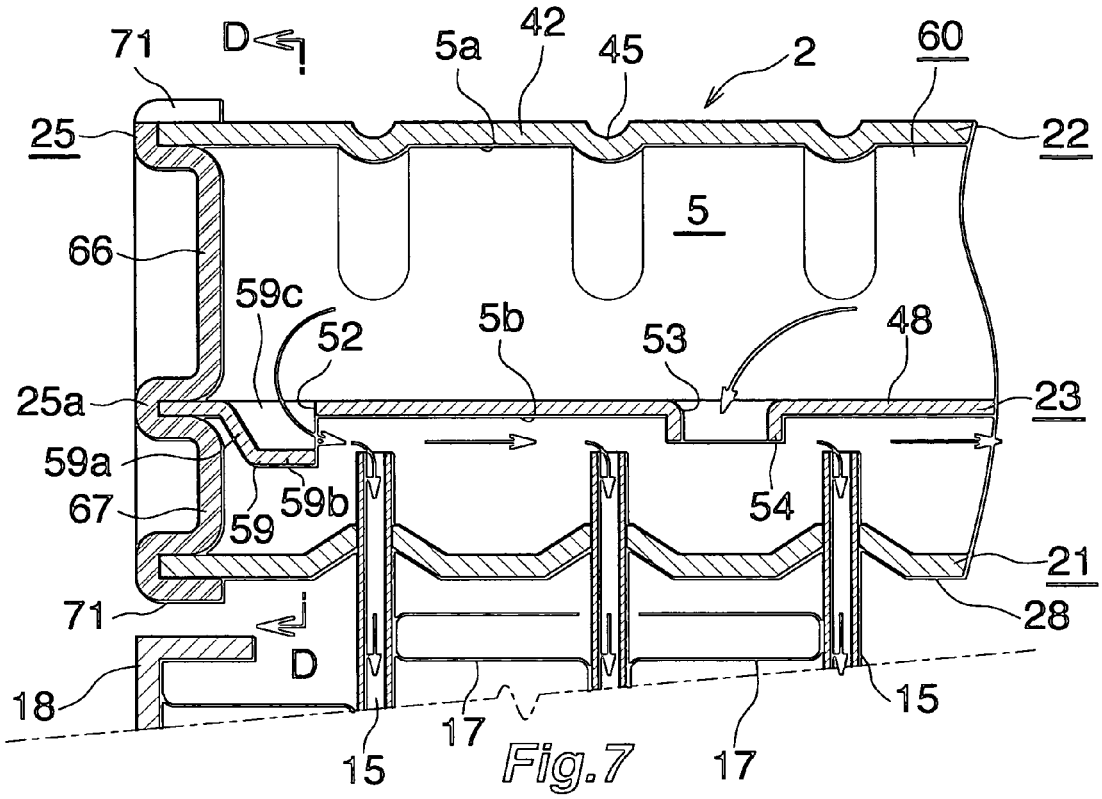
FIG. 7 is an enlarged view of a main portion of FIG. 6.
Figure 8:
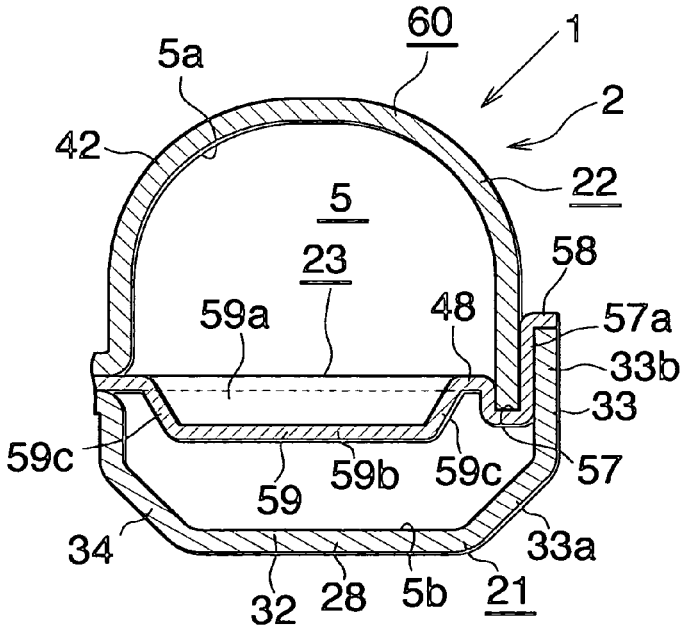
FIG. 8 is a cross sectional view taken along line D-D of FIG. 7.

The front partition portion (48) of the partition plate (23) has a communication opening (52) which is formed in a left end portion (an end portion opposite the refrigerant inlet (77)) of the front partition portion (48) to be located on the left side of a heat exchange tube (15) provided in the left end portion. The communication opening (52) is elongated in the front-rear direction as viewed from above, and establishes communication between the upper and lower spaces (5*a*) and (5*b*) of the refrigerant inlet header section (5). The front partition portion (48) has an integrally formed guide section (59) which projects from a left edge portion of the communication opening (52) into the lower space (5*b*) so as to guide refrigerant to flow rightward. As shown in FIGS. 7 and 8, the guide portion (59) includes a guide slant portion (59*a*) which inclines downward (toward the side where the heat exchange tubes (15) are present) toward the right (the side where the refrigerant inlet (77) is present); a horizontal portion (59*b*) which extends rightward from the distal end of the slant portion (59*a*); and connection portions (59*c*) which are integrally formed at front and rear edges of the communication opening (52) of the front partition portion (48) such that they incline downward toward the inner side with respect to the front-rear direction, and connect front and rear edge portions of the slant portion (59*a*) and the horizontal portion (59*b*) to the front partition portion (48). The distal end (right end) of the horizontal portion (59*b*) of the guide portion (59) is generally located immediately under the right edge of the communication opening (52) formed in the front partition portion (48) of the partition plate (23). Notably, the upper surface of the horizontal portion (59*b*) of the guide portion (59) is located at generally the same height as the upper ends of the heat exchange tubes (15).

In a central portion of the front partition portion (48) with respect to the front-rear direction, a plurality of refrigerant-passage circular through holes (53) are formed at predetermined intervals in the left-right direction so as to establish communication between the upper and lower spaces (5*a*) and (5*b*) of the refrigerant inlet header section (5). Flanges (54) in the form of a short circular tube are integrally formed on the lower surface (the surface facing the heat exchange tubes (15)) of the front partition portion (48) such that the flanges (54) project downward (toward the heat exchange tubes (15)) from the circumferential edges of the corresponding through holes (53) and surround the corresponding through holes (53). Each through hole (53) and the corresponding flange (54) are formed between two adjacent heat exchange tubes (15). Further, in the rear partition portion (49) of the partition plate (23), excluding left and right end portions thereof, a plurality of refrigerant-passage elliptical through holes (55A) and (55B) are formed at predetermined intervals in the left-right direction such that the through holes (55A) and (55B) elongate in the left-right direction and establish communication between the upper and lower spaces (6*a*) and (6*b*) of the refrigerant outlet header section (6). Flanges (56A) and (56B) in the form of a short tube are integrally formed on the upper surface of the rear partition portion (49) such that the flanges (56A) and (56B) project upward from the circumferential edges of the corresponding through holes (55A) and (55B) and surround the corresponding through holes (55A) and (55B). The central elliptical through hole (55A) is shorter than the remaining elliptical through holes (55B), and is located between adjacent heat exchange tubes (15). Further, drain through holes (62) are formed in the connection wall (51) of the partition plate (23) at positions corresponding to the drain through holes (39) of the first member (21) and the drain through holes (46) of the second member (22); and fixation through holes (63) are formed in the connection wall (51) of the partition plate (23) at positions corresponding to the fixation through holes (41) of the first member (21) and the fixation through holes (47) of the second member (22).

The front and rear edge portions of the partition plate (23); i.e., the front edge portion of the front partition portion (48) and the rear edge portion of the rear partition portion (49), each have a receiving groove (57) which opens upward and extends in the left-right direction over the entire length. The second member (22) and the partition plate (23) are brazed together in a state in which a lower end portion of the front wall of the first header forming portion (42) of the second member (22) and a lower end portion of the rear wall of the second header forming portion (43) of the second member (22) are fitted into the corresponding receiving groove (57). Outer walls (57*a*) of the front and rear receiving groove (57) of the partition plate (23) with respect to the front-rear direction project upward in relation to inner walls of the front and rear receiving groove (57). Further, the outer walls (57*a*) have, at their upper edges, ridges (58) integrally formed over the entire length such that the ridges project outward with respect to the front-rear direction. The first member (21) and the partition plate (23) are brazed together in a state in which the vertical portion (33*b*) of the front wall (33) of the first header forming section (28) of the first member (21) and the vertical portion (36*b*) of the rear wall (36) of the second header forming section (29) run along the outer surfaces of the outer walls (57*a*) of the corresponding receiving grooves (57), and the upper ends of the vertical portions (33*b*) and (36*b*) are in contact with the corresponding ridges (58).

The first header forming portion (28) of the first member (21), the first header forming portion (42) of the second member (22), and the front partition portion (48) of the partition plate (23) form an inlet-header-section main body (60). The second header forming portion (29) of the first member (21), the second header forming portion (43) of the second member (22), and the rear partition portion (49) of the partition plate (23) form an outlet-header-section main body (61).

The provisional fixing member (24) assumes the form of a vertical strip-like plate elongated in the left-right direction. The provisional fixing member (24) has projections (64) which project downward from the lower edge thereof at positions corresponding to the fixation through holes (41), (47), and (63) of the first member (21), the second member (22), and the partition plate (23). The projections (64) are inserted into these fixation through holes (41), (47), and (63), and are brazed to the connection walls (31), (44), and (51). Further, the provisional fixing member (24) has cutouts (65) which extend upward from the lower edge thereof at positions corresponding to the drain through holes (39), (46), and (62) of the first member (21), the second member (22), and the partition plate (23). The width of the opening of each cutout (65) as measured in the left-right direction is equal to that of the drain through holes (39), (46), and (62). The provisional fixing member (24) is formed by performing press working on a plate made of an aluminum bare material such that the projections (64) and the cutouts (65) are formed.

The left end member (25) includes a front cap (25*a*) for closing the left end opening of the inlet-header-section main body (60), and a rear cap (25*b*) for closing the left end opening of the outlet-header-section main body (61). The front cap (25*a*) and the rear cap (25*b*) are integrated together via a connection portion (25*c*). The front cap (25*a*) includes an upper rightward projecting portion (66) and a lower rightward projecting portion (67) integrally formed such that they are separated from each other in the vertical direction. The upper rightward projecting portion (66) is fitted into the space (5*a*) of the inlet-header-section main body (60) located above the front partition portion (48) of the partition plate (23). The lower rightward projecting portion (67) is fitted into the space (5*b*) of the inlet-header-section main body (60) located below the front partition portion (48). Similarly, the rear cap (25*b*) includes an upper rightward projecting portion (68) and a lower rightward projecting portion (69) integrally formed such that they are separated from each other in the vertical direction. The upper rightward projecting portion (68) is fitted into the space (6*a*) of the outlet-header-section main body (61) located above the rear partition portion (49) of the partition plate (23). The lower rightward projecting portion (69) is fitted into the space (6*b*) of the outlet-header-section main body (61) located below the rear partition portion (49). Engagement fingers (71) projecting rightward for engagement with the first and second members (21) and (22) are formed integrally with the left end member (25) at connection portions between the front and rear side edges and the upper and lower edges. The left end member (25) is brazed to the two members (21) and (22) and the partition plate (23) by making use of the brazing material layer of itself. A left end portion of the front partition portion (48) of the partition plate (23) is fitted between the upper rightward projecting portion (66) and the lower rightward projecting portion (67) of the front cap (25*a*) of the left end member (25), and brazed to the front cap (25*a*) of the left end member (25) (see FIGS. 6 and 7). Further, a left end portion of the rear partition portion (49) of the partition plate (23) is fitted between the upper rightward projecting portion (68) and the lower rightward projecting portion (69) of the rear cap (25*b*) of the left end member (25), and brazed to the rear cap (25*b*) of the left end member (25) (see FIG. 2). Moreover, a left end portion of the connection portion (51) of the partition plate (23) is brazed to the connection portion (25*c*) of the left end member (25) while being brought into contact therewith.

The right end member (26) includes a front cap (26*a*) for closing the right end opening of the inlet-header-section main body (60), and a rear cap (26*b*) for closing the right end opening of the outlet-header-section main body (61). The front cap (26*a*) and the rear cap (26*b*) are integrated together via a connection portion (26*c*). The front cap (26*a*) of the right end member (26) includes an upper leftward projecting portion (73) and a lower leftward projecting portion (74) integrally formed such that they are separated from each other in the vertical direction. The upper leftward projecting portion (73) is fitted into the space (5*a*) of the inlet-header-section main body (60) located above the front partition portion (48) of the partition plate (23). The lower leftward projecting portion (74) is fitted into the space (5*b*) of the inlet-header-section main body (60) located below the front partition portion (48). Similarly, the rear cap (26*b*) includes an upper leftward projecting portion (75) and a lower leftward projecting portion (76) integrally formed such that they are separated from each other in the vertical direction. The upper leftward projecting portion (75) is fitted into the space (6*a*) of the outlet-header-section main body (61) located above the rear partition portion (49) of the partition plate (23). The lower leftward projecting portion (76) is fitted into the space (6*b*) of the outlet-header-section main body (61) located below the rear partition portion (49). A refrigerant inlet (77) is formed in a projecting end wall of the upper leftward projecting portion (73) of the front cap (26*a*) of the right end member (26). Similarly, a refrigerant outlet (78) is formed in a projecting end wall of the upper leftward projecting portion (75) of the rear cap (26*b*) of the right end member (26). Engagement fingers (79) projecting leftward for engagement with the first and second members (21) and (22) are formed integrally with the right end member (26) at connection portions between the front and rear side edges and the upper edge, and at front and rear portions of the lower edge.

Figure 9:
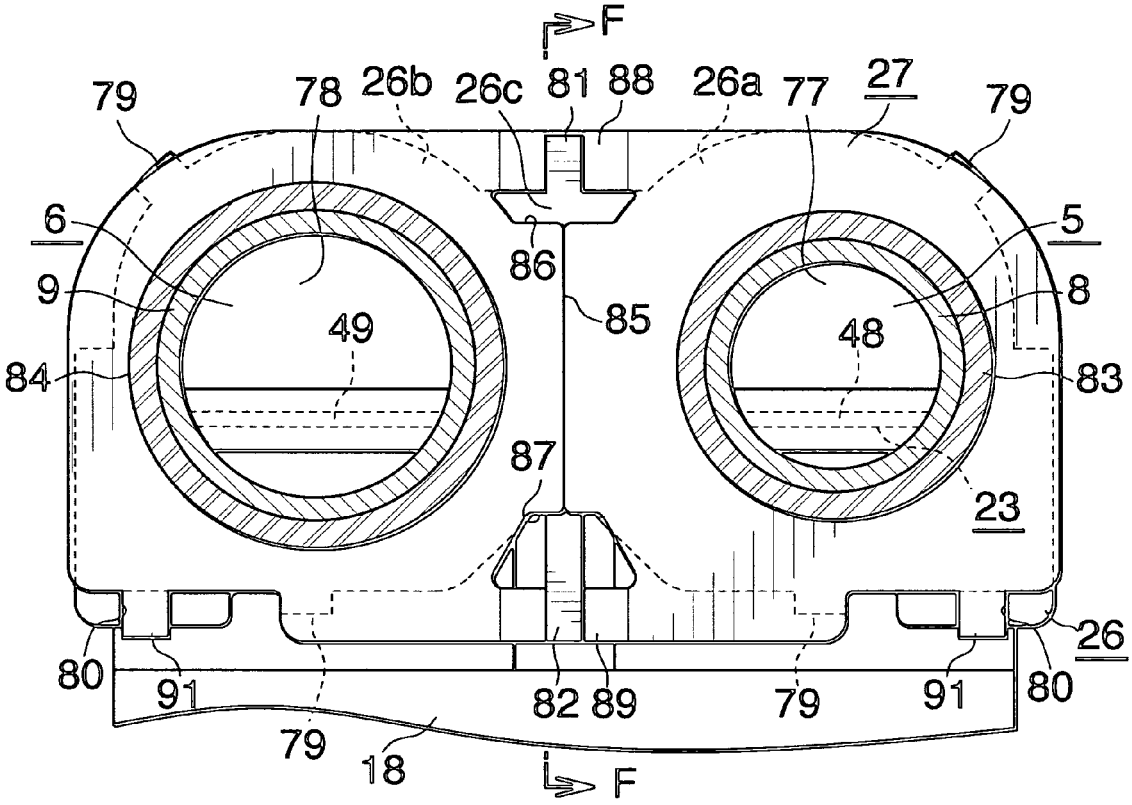
FIG. 9 is an enlarged cross sectional view taken along line E-E of FIG. 4.
Figure 10:
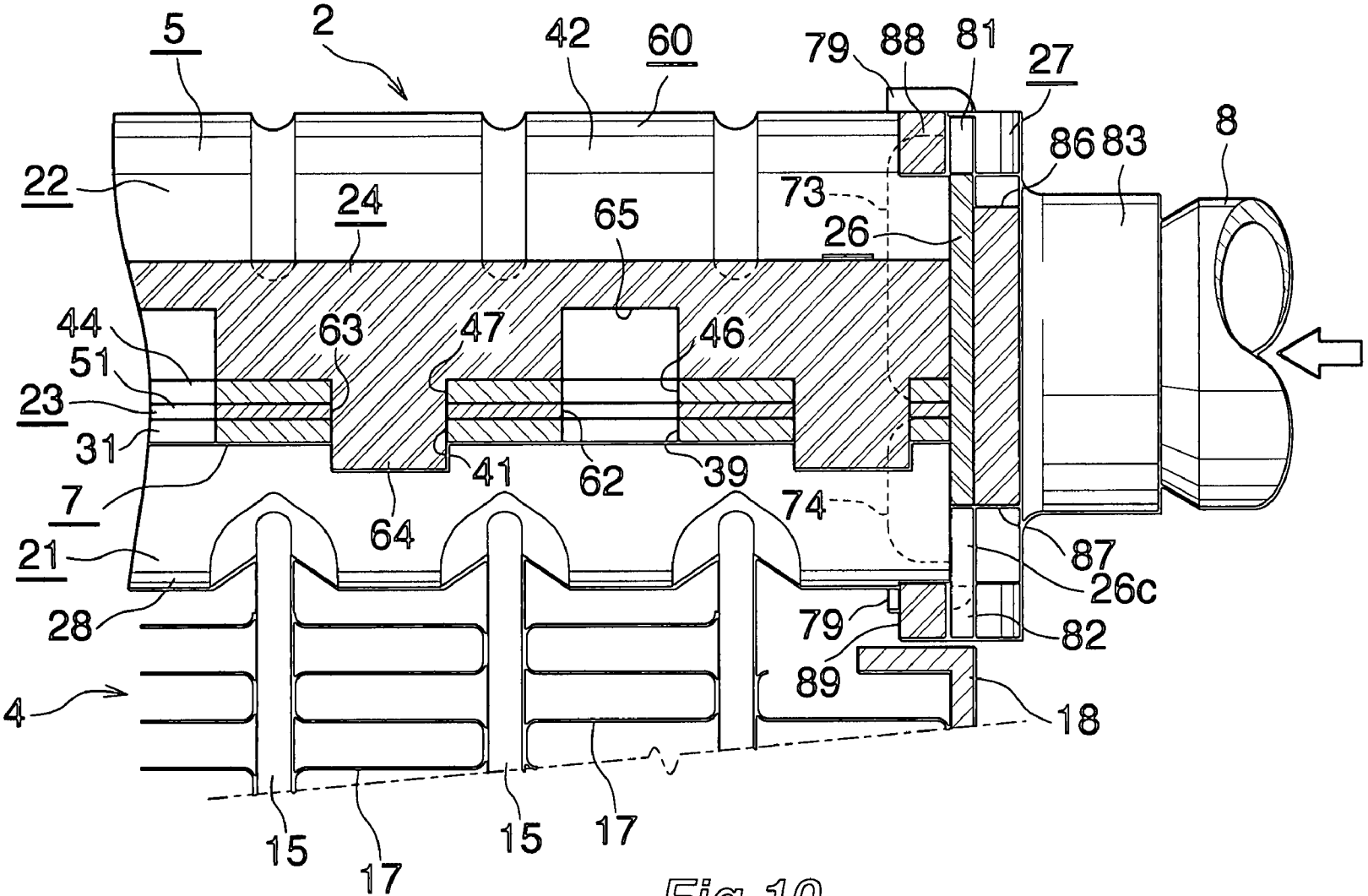
FIG. 10 is an enlarged cross sectional view taken along line F-F of FIG. 9.
Figure 11:
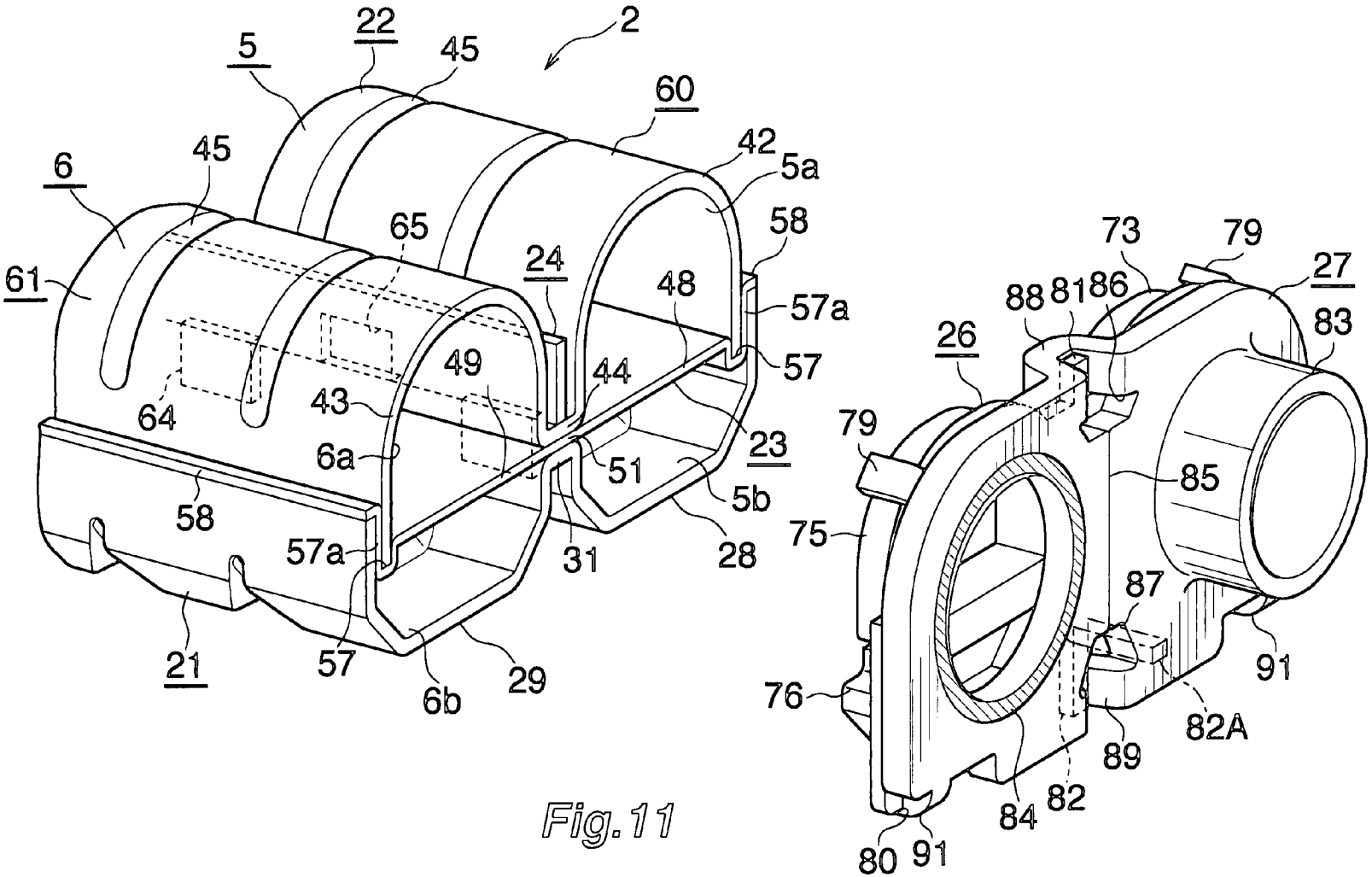
FIG. 11 is a partial exploded perspective view showing a joint plate and a right end portion of the refrigerant inlet/outlet header tank of the evaporator shown in FIG. 1.
Figure 12:
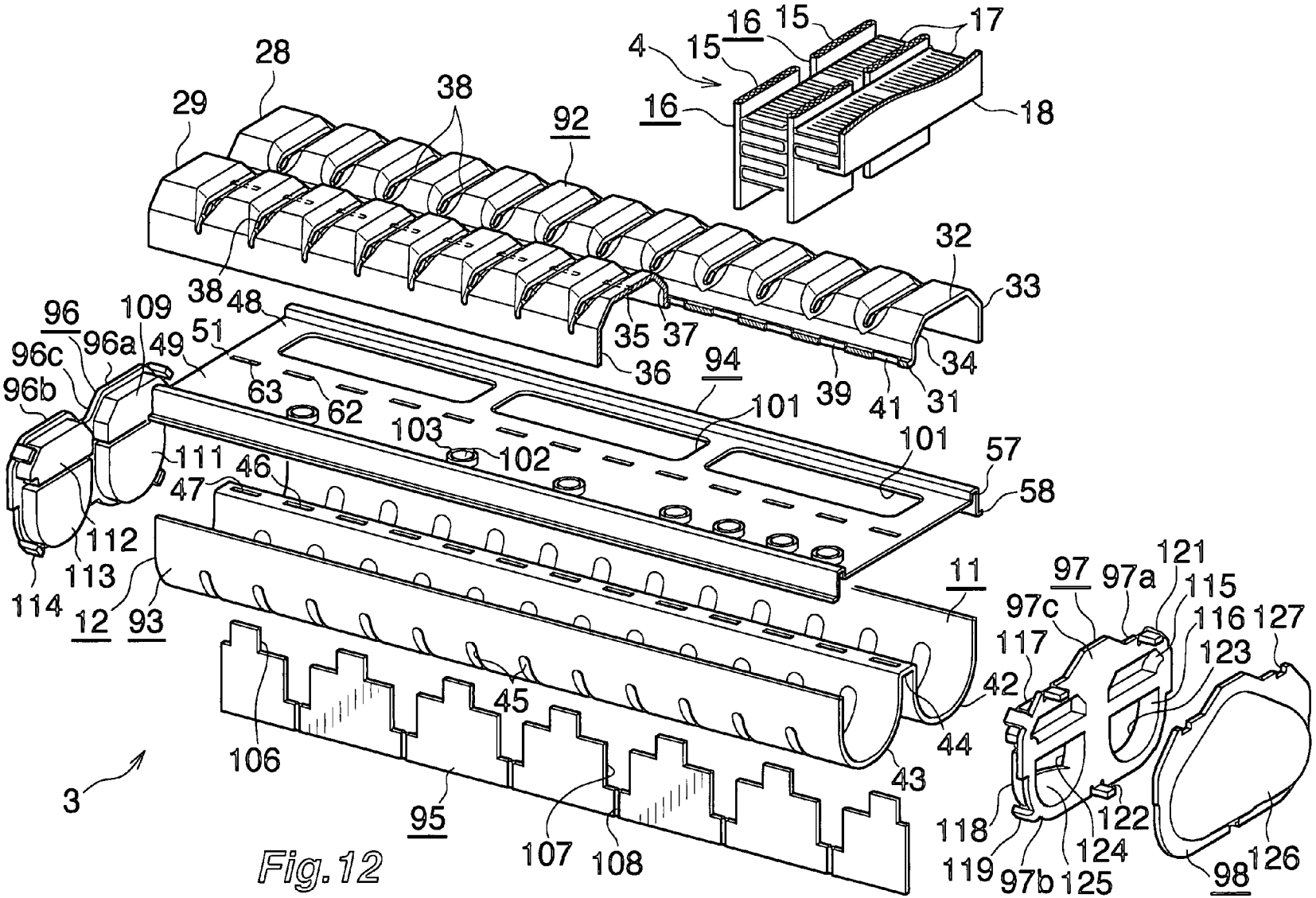
FIG. 12 is an exploded perspective view of a refrigerant turn header tank of the evaporator shown in FIG. 1.
Figure 13:
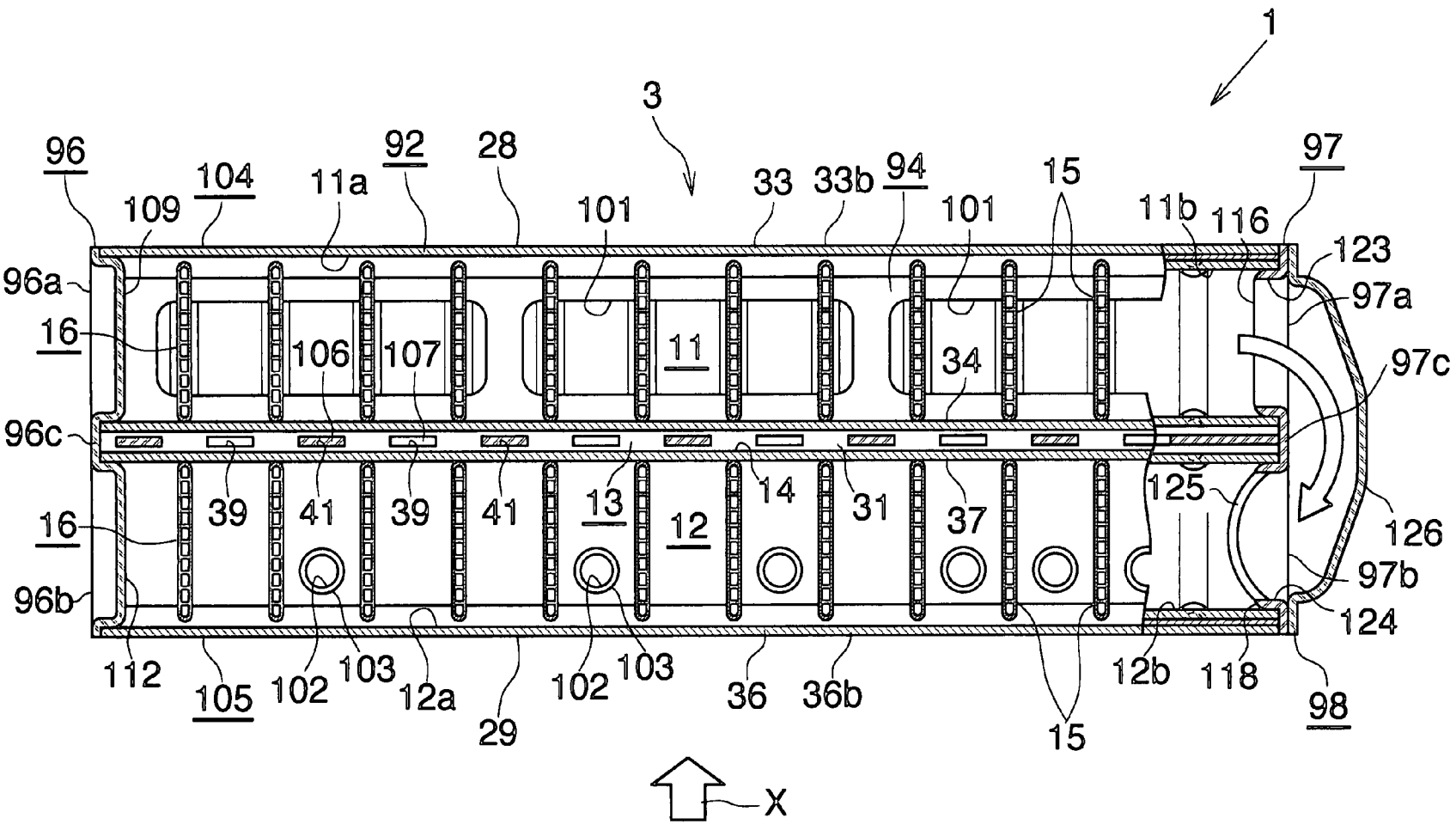
FIG. 13 is an enlarged cross sectional view taken along line G-G of FIG. 2.

As shown in FIGS. 9 to 11, a first engagement male portion (81) is formed integrally with the connection portion (26*c*) of the right end member (26) such that the first engagement male portion (81) projects upward from a central portion of the upper end of the connection portion (26*c*) with respect to the front-rear direction. Similarly, a second engagement male portion (82) is formed integrally with the connection portion (26*c*) of the right end member (26) such that the second engagement male portion (82) projects downward from a central portion of the lower end of the connection portion (26*c*) with respect to the front-rear direction. In a state before the right end member (26) is assembled to the joint plate (27) during the manufacture of the evaporator (1), the second engagement male portion (82) projects rightward. The second engagement male portion (82) projecting rightward is denoted by (82A) (indicated by a chain line in FIG. 11). Further, cutouts (80) are formed in front and rear end potions of a lower edge portion of the right end member (26). The right end member (26) is brazed to the members (21) and (22) and the partition plate (23) by making use of the brazing material layer of itself. A right end portion of the front partition portion (48) of the partition plate (23) is fitted between the upper leftward projecting portion (73) and the lower leftward projecting portion (74) of the front cap (26*a*) of the right end member (26), and brazed to the front cap (26*a*) of the right end member (26) (see FIG. 6). Further, a right end portion of the rear partition portion (49) of the partition plate (23) is fitted between the upper left projecting portion (75) and the lower left projecting portion (76) of the rear cap (26*b*) of the right end member (26), and brazed to the rear cap (26*b*) of the right end member (26) (see FIG. 2). Moreover, a right end portion of the connection portion (51) of the partition plate (23) is brazed to the connection portion (26*c*) of the right end member (26) while being brought into contact therewith (see FIG. 10).

The joint plate (27) includes a short, cylindrical refrigerant inflow port (83) communicating with the refrigerant inlet (77) of the right end member (26), and a short, cylindrical refrigerant outflow port (84) communicating with the refrigerant outlet (78) of the right end member (26). The refrigerant inflow port (83) and the refrigerant outflow port (84) are each composed of a circular through hole and a short cylindrical tubular portion formed integrally with the joint plate (27) such that the short cylindrical tubular portion surrounds the through hole and projects rightward.

The joint plate (27) has a vertically extending slit for short prevention (85) formed between the refrigerant inflow port (83) and the refrigerant outflow port (84), and generally trapezoidal through holes (86) and (87) communicating with the upper and lower ends of the slit (85), respectively. Portions of the joint plate (27) located above the upper through hole (86) and below the lower through hole (87) are bent in a U-like shape so as to project leftward to thereby form first and second engagement female portions (88) and (89). The first engagement male portion (81) of the right end member (26) is inserted into the first engagement female portion (88) from the lower side thereof for engagement with the first engagement female portion (88). The second engagement male portion (82) of the right end member (26) is inserted into the second engagement female portion (89) from the upper side thereof for engagement with the second engagement female portion (89). Thus, movement of the joint plate (27) in the left-right direction is prevented. The second engagement male portion (82) of the right end member (26) in a state in which it projects rightward as shown by a chain line in FIG. 11 is passed through the lower through hole (87), and then bent downward, whereby the second engagement male portion (82) is inserted into the second engagement female portion (89) from the upper side thereof. The first engagement female portion (88) is in engagement with front and rear side portions of the first engagement male portion (81) of the connection portion (26*c*) of the right end member (26), whereby downward movement of the joint plate (27) is prevented. Moreover, engagement fingers (91) projecting leftward are formed integrally with the joint plate (27) at front and rear end portions of the lower edge thereof. The joint plate (27) is engaged with the right end member (26) with the engagement fingers (91) fitted into the cutouts (80) formed along the lower edge of the right end member (26). Thus, upward, frontward, and rearward movements of the joint plate (27) are prevented. The joint plate (27) is brazed to the right end member (26) by making use of the brazing material layer of the right end member (26) in a state in which the joint plate (27) is engaged with the right end member (26) such that leftward and rightward movements, upward and downward movements, and frontward and rearward movements of the joint plate (27) are prevented as described above.

A diameter-reduced portion of the refrigerant inlet pipe (8) formed at one end thereof is inserted into and brazed to the refrigerant inflow port (83) of the joint plate (27). Similarly, a diameter-reduced portion of the refrigerant outlet pipe (9) formed at one end thereof is inserted into and brazed to the refrigerant inflow port (84) of the joint plate (27). Although not illustrated in the drawings, an expansion valve attachment member is joined to the opposite end portions of the refrigerant inlet pipe (8) and the refrigerant outlet pipe (9) such that the expansion valve attachment member extends over the two pipes (8) and (9).

As shown in FIGS. 2, 3, 12, and 13, the refrigerant turn header tank (3) is composed of a plate-like first member (92), a second member (93), a partition plate (94), a provisional fixing member (95), aluminum end members (96) and (97), and a communication member (98). The first member (92) is formed through press working from an aluminum brazing sheet having a brazing material layer over opposite surfaces thereof. All the heat exchange tubes (15) are connected to the first member (92). The second member (93) is formed through press working from an aluminum brazing sheet having a brazing material layer over opposite surfaces thereof, and covers the lower side (the side opposite the heat exchange tubes (15)) of the first member (92). The partition plate (94) is formed through press working from an aluminum bare material or an aluminum brazing sheet having a brazing material layer over opposite surfaces thereof, and is disposed between the first member (92) and the second member (93) so as to divide the interiors of the first intermediate header section (11) and the second intermediate header section (12) into upper and lower spaces (11*a*) and (11*b*) and into upper and lower spaces (12*a*) and (12*b*), respectively. The provisional fixing member (95) is formed through press working from an aluminum bare material, and is used for provisionally fix the first member (92), the second member (93), and the partition plate (94). The aluminum end members (96) and (97) are formed through press working from an aluminum brazing sheet having a brazing material layer over opposite surfaces thereof, and are brazed to the left and right ends of the first member (92), the second member (93), and the partition plate (94). The communication member (98), which is made of an aluminum bare material and extends in the front-rear direction, is brazed to an outer surface of the right end member (97) such that the communication member (98) extends over the first intermediate header section (11) and the second intermediate header section (12). The first intermediate header section (11) and the second intermediate header section (12) communicate with each other at their right ends via the communication member (98).

The first member (92) has the same structure as the first member (21) of the refrigerant inlet/outlet header tank (2), and is a mirror image of the first member (21) with respect to the vertical direction. Like portions are denoted by like reference numerals. A first header forming portion (28) forms an upper portion of the first intermediate header section (11); and a second header forming portion (29) forms an upper portion of the second intermediate header section (12). Lower end portions of the heat exchange tubes (15) of the front and rear heat exchange tube groups (16) of the heat exchange core section (4) are inserted into tube insertion holes (38), and are brazed to the first member (92) by making use of the brazing material layer of the first member (92). Thus, the lower end portions of the heat exchange tubes (15) of the front heat exchange tube group (16) are connected to the first intermediate header section (11) such that fluid communication is established therebetween; and the lower end portions of the heat exchange tubes (15) of the rear heat exchange tube group (16) are connected to the second intermediate header section (12) such that fluid communication is established therebetween.

The second member (93) has the same structure as the second member (22) of the refrigerant inlet/outlet header tank (2), and is a mirror image of the second member (22) with respect to the vertical direction. Like portions are denoted by like reference numerals. A first header forming portion (42)

forms a lower portion of the first intermediate header section (11); and a second header forming portion (43) forms a lower portion of the second intermediate header section (12).

The partition plate (94) (the plate-shaped partition member) has the same structure as the partition plate (23) of the refrigerant inlet/outlet header tank (2), except for the structure of the front and rear partition portions (48) and (49), and is a mirror image of the partition plate (23) with respect to the vertical direction. Like portions are denoted by like reference numerals. The front partition portion (48), which divides the interior of the first intermediate header section (11) into upper and lower spaces (11*a*) and (11*b*), has a plurality of relatively large rectangular through holes (101) formed at predetermined intervals in the left-right direction such that they extend in the left-right direction. Further, the rear partition portion (49), which divides the interior of the second intermediate header section (12) into upper and lower spaces (12*a*) and (12*b*), has a plurality of circular refrigerant-passage through holes (102) formed through a rear portion of the rear partition portion (49) at predetermined intervals in the left-right direction. The distance between adjacent circular refrigerant-passage through holes (102) gradually increases with the distance from the right end. Flanges (103) in the form of a short circular tube are integrally formed on the upper surface (the surface facing the heat exchange tubes (15)) of the rear partition portion (49) such that the flanges (103) project upward (toward the heat exchange tubes (15)) from the circumferential edges of the corresponding through holes (102) and surround the corresponding through holes (102). Each through hole (102) and the corresponding flange (103) are formed between two adjacent heat exchange tubes (15). Notably, the distance between adjacent circular refrigerant-passage through holes (102) may be constant among all the circular refrigerant-passage through holes (102).

The first member (92), the second member (93), and the partition plate (94) are assembled and brazed together in the same manner as in the case of the first member (21), the second member (22), and the partition plate (23) of the refrigerant inlet/outlet header tank (2). Thus, the first header forming portion (28) of the first member (92), the first header forming portion (42) of the second member (93), and the front partition portion (48) of the partition plate (94) form a first-intermediate-section main body (104), which is hollow and is opened at opposite ends thereof; and the second header forming portion (29) of the first member (92), the second header forming portion (43) of the second member (93), and the rear partition portion (49) of the partition plate (94) form a second-intermediate-section main body (105), which is hollow and is opened at opposite ends thereof.

The provisional fixing member (95) assumes the form of a vertical strip-like plate elongated in the left-right direction. The provisional fixing member (95) has projections (106) which project upward from the upper edge thereof at positions corresponding to fixation through holes (41), (47), and (63) of the first member (92), the second member (93), and the partition plate (94). The projections (106) are inserted into these fixation through holes (41), (47), and (63), and are brazed to connection walls (31), (44), and (51). Further, the provisional fixing member (95) has cutouts (107) which extend downward from the upper edge thereof at positions corresponding to drain through holes (39), (46), and (62) of the first member (92), the second member (93), and the partition plate (94). The width of the opening of each cutout (107) as measured in the left-right direction is equal to that of the drain through holes (39), (46), and (62). Drain assisting grooves (108) are formed on the front and rear surfaces of the provisional fixing member (95) such that the drain assisting grooves (108) extend downward from the lower ends of the cutouts (107), and the lower ends of the drain assisting grooves (108) are opened to the lower end surface of the provisional fixing member (95). The provisional fixing member (95) is formed by performing press working on a plate made of an aluminum bare material such that the projections (106), the cutouts (107), and the drain assisting grooves (108) are formed.

The left end member (96) is a mirror image of the left end member (25) of the refrigerant inlet/outlet header tank (2) with respect to the vertical direction. The left end member (96) includes a front cap (96*a*) for closing the left end opening of the first-intermediate-header-section main body (104), and a rear cap (96*b*) for closing the left end opening of the second-intermediate-header-section main body (105). The front cap (96*a*) and the rear cap (96*b*) are integrated together via a connection portion (96*c*). The front cap (96*a*) includes an upper rightward projecting portion (109) and a lower rightward projecting portion (111) integrally formed such that they are separated from each other in the vertical direction. The upper rightward projecting portion (109) is fitted into the space (11*a*) of the first-intermediate-header-section main body (104) located above the front partition portion (48) of the partition plate (94). The lower rightward projecting portion (111) is fitted into the space (11*b*) of the first-intermediate-header-section main body (104) located below the front partition portion (48). Similarly, the rear cap (96*b*) includes an upper rightward projecting portion (112) and a lower rightward projecting portion (113) integrally formed such that they are separated from each other in the vertical direction. The upper rightward projecting portion (112) is fitted into the space (12*a*) of the second-intermediate-header-section main body (105) located above the rear partition portion (49) of the partition plate (94). The lower rightward projecting portion (113) is fitted into the space (12*b*) of the second-intermediate-header-section main body (105) located below the rear partition portion (49). Engagement fingers (114) projecting rightward for engagement with the first and second members (92) and (93) are formed integrally with the left end member (96) at connection portions between the front and rear side edges and the upper and lower edges. The left end member (96) is brazed to the two members (92) and (93) and the partition plate (94) by making use of the brazing material layer of itself. A left end portion of the front partition portion (48) of the partition plate (94) is fitted between the upper rightward projecting portion (109) and the lower rightward projecting portion (111) of the front cap (96*a*) of the left end member (96), and brazed to the front cap (96*a*) of the left end member (96). Further, a left end portion of the rear partition portion (49) of the partition plate (94) is fitted between the upper rightward projecting portion (112) and the lower rightward projecting portion (113) of the rear cap (96*b*) of the left end member (96), and brazed to the rear cap (96*b*) of the left end member (96) (see FIG. 2). Moreover, a left end portion of the connection portion (51) of the partition plate (94) is brazed to the connection portion (96*c*) of the left end member (96) while being brought into contact therewith.

The right end member (97) includes a front cap (97*a*) for closing the right end opening of the first-intermediate-header-section main body (104), and a rear cap (97*b*) for closing the right end opening of the second-intermediate-header-section main body (105). The front cap (97*a*) and the rear cap (97*b*) are integrated together via a connection portion (97*c*). The front cap (97*a*) includes an upper leftward projecting portion (115) and a lower leftward projecting portion (116) integrally formed such that they are separated from each other in the vertical direction. The upper leftward projecting portion (115) is fitted into the space (11*a*) of the first-intermediate-header-section main body (104) located above the front partition portion (48) of the partition plate (94). The lower leftward projecting portion (116) is fitted into the space (11*b*) of the first-intermediate-header-section main body (104) located below the front partition portion (48). Similarly, the rear cap (97*b*) includes an upper leftward projecting portion (117) and a lower rightward projecting portion (118) integrally formed such that they are separated from each other in the vertical direction. The upper leftward projecting portion (117) is fitted into the space (12*a*) of the second-intermediate-header-section main body (105) located above the rear partition portion (49) of the partition plate (94). The lower leftward projecting portion (118) is fitted into the space (12*b*) of the second-intermediate-header-section main body (105) located below the rear partition portion (49). Engagement fingers (119) projecting leftward for engagement with the first and second members (92) and (93) are formed integrally with the right end member (97) at connection portions between the front and rear side edges and the upper and lower edges.

The right end member (97) has integrally formed engagement fingers (121) which project rightward from front and rear end portions of the upper edge of the right end member (97). The engagement fingers (121) are bent downward for engagement with an upper edge portion of the communication member (98). The right end member (97) also has an integrally formed engagement finger (122) which projects rightward from a central portion of the lower edge of the right end member (97) with respect to the front-rear direction. The engagement finger (122) is bent upward for engagement with a lower edge portion of the communication member (98). Notably, in FIG. 12, the engagement fingers (121) and (122) are shown in a straight state before being bent. A refrigerant outflow opening (123) is formed in a projecting end wall of the lower leftward projecting portion (116) of the front cap (97*a*) of the right end member (97) so as to allow refrigerant to flow out of the space (11*b*) of the first intermediate header section (11) located below the front partition portion (48). Similarly, a refrigerant inflow opening (124) is formed in a projecting end wall of the lower leftward projecting portion (118) of the rear cap (97*b*) of the right end member (97) so as to allow refrigerant to flow into the space (12*b*) of the second intermediate header section (12) located below the rear partition portion (49). Further, a guide portion (125), which is upwardly inclined or curbed (in the present embodiment, curved) toward the interior of the second intermediate header section (12), is integrally formed at a lower portion of the circumferential edge of the refrigerant inflow opening (124) of the lower leftward projecting portion (118) of the rear cap (97*b*). The guide portion (125) guides upward the refrigerant flowing into the space (12*b*) of the second intermediate header section (12) located below the rear partition portion (49). The right end member (97) is brazed to the first and second members (92) and (93) and the partition plate (94) by making use of the brazing material layer of itself. A right end portion of the front partition portion (48) of the partition plate (94) is fitted between the upper leftward projecting portion (115) and the lower leftward projecting portion (116) of the front cap (97*a*) of the right end member (97), and brazed to the front cap (97*a*) of the right end member (97). Further, a right end portion of the rear partition portion (49) of the partition plate (94) is fitted between the upper left projecting portion (117) and the lower left projecting portion (118) of the rear cap (97*b*) of the right end member (97), and brazed to the rear cap (97*b*) of the right end member (97) (see FIG. 2). Moreover, a right end portion of the connection portion (51) of the partition plate (94) is brazed to the connection portion (97*c*) of the right end member (97) while being brought into contact therewith.

The communication member (98) is formed from an aluminum bare material through press working, and assumes the form of a plate whose outer shape is identical in shape and size with the right end member (97) as viewed from the right. A circumferential edge portion of the communication member (98) is brazed to the outer surface of the right end member (97) by making use of the brazing material layer of the right end member (97). The communication member (98) has an outwardly bulging portion (126) for establishing communication between the refrigerant outflow opening (123) and the refrigerant inflow opening (124) of the right end member (97). The interior of the outwardly bulging portion (126) serves as a communication passage for establishing communication between the refrigerant outflow opening (123) and the refrigerant inflow opening (124) of the right end member (97). Cutouts (127) for receiving the engagement fingers (121) and (122) of the right end member (97) are formed at front end rear end portions of the upper edge of the communication member (98), as well as at a central portion of the lower edge of the communication member (98) with respect to the front-rear direction.

In manufacture of the above-described evaporator (1), all the components thereof, excluding the inlet pipe (8) and the outlet pipe (9), are assembled together, and the resultant assembly is subjected to batch brazing.

The evaporator (1), together with a compressor and a condenser (serving as a refrigerant cooler), constitutes a refrigeration cycle, which uses a chlorofluorocarbon-based refrigerant and is installed in a vehicle, for example, an automobile, as a car air conditioner.

In the evaporator (1) described above, when the compressor is on, two-phase refrigerant of vapor-liquid phase having passed through the compressor, the condenser, and an expansion valve enters the upper space (5*a*) of the refrigerant inlet header section (5) of the refrigerant inlet/outlet header tank (2) from the refrigerant inlet pipe (8) through the refrigerant inflow port (83) of the joint plate (27) and the refrigerant inlet (77) of the front cap (26*a*) of the right end member (26). Then, the refrigerant having entered the upper space (5*a*) of the refrigerant inlet header section (5) flows leftward and subsequently flows into the lower space (5*b*) via the communication hole (52), as well as the through holes (53) of the front partition portion (48) of the partition plate (23). When the refrigerant flows from the upper space (5*a*) into the lower space (5*b*) via the communication hole (52), the refrigerant is guided by the guide portion (59), so that the refrigerant flows smoothly toward the right end portion. Accordingly, the refrigerant is prevented from hitting, due to the flow force, against portions of the bottom wall (32), the front wall (33), and the rear wall (34) of the first header forming section (28) (to which the heat exchange tubes (15) are connected) of the first member (21) of the refrigerant inlet header section (5), the portions being generally located immediately under the communication opening (52) (a portion corresponding to the communication opening (52)), and changing its flow direction toward the front partition portion (48). As a result, the refrigerant becomes more likely to flow into several heat exchange tubes (15) located at the left end portion. Therefore, even when the amount of refrigerant is large, the outflow air temperature, which is the temperature of air having passed through the evaporator (1), is made uniform at the left end portion, and the degree of uniformity of the outflow air temperature can be increased.

The refrigerant having entered the lower space (5*b*) dividedly flows into the refrigerant channels of the heat exchange tubes (15) of the front heat exchange tube group (16). The refrigerant having entered the refrigerant channels of the heat exchange tubes (15) flows downward through the refrigerant channels and enters the upper space (11*a*) of the first intermediate header section (11) of the refrigerant turn header tank (3). The refrigerant having entered the upper space (11*a*) of the first intermediate header section (11) enters the lower space (11*b*) via the through holes (101) of the front partition portion (48) of the partition plate (94), and then flows rightward in the lower space (11*b*). The refrigerant then flows through the refrigerant outflow opening (123) of the front cap (97*a*) of the right end member (97), the communication passage within the outward bulging portion (126) of the communication member (98), and the refrigerant inflow opening (124) of the rear cap (97*b*), thereby changing its flow direction to make a turn and entering the lower space (12*b*) of the second intermediate header section (12).

The refrigerant having entered the lower space (12*b*) of the second intermediate header section (12) flows leftward; enters the upper space (12*a*) via the through holes (102) of the rear partition portion (49) of the partition member (94); and dividedly flows into the refrigerant channels of the heat exchange tubes (15) of the rear heat exchange tube group (16). At that time, the guide portion (125) guides the refrigerant to flow in an upwardly inclined leftward direction; i.e., flow into the lower space (12*b*) toward the rear partition portion (49). As a result, in cooperation with the through holes (102) formed in the rear partition portion (49) such that the distance between adjacent through holes (102) gradually increases toward the left end, the distribution (in the left-right direction) of the refrigerant flowing into the upper space (12*a*) via the through holes (102) is made uniform as compared with the case where the guide portion (125) is not provided. Therefore, the refrigerant becomes more likely to uniformly flow into the heat exchange tubes (15) connected to the second intermediate header section (12). Accordingly, the distribution of the refrigerant in the heat exchange core section (4) hardly becomes non-uniform, whereby the temperature of air having passed through the heat exchange core section (4) becomes uniform, and the heat exchange performance is improved.

The refrigerant having flown into the refrigerant channels of the heat exchange tubes (15) flows upward within the refrigerant channels, while changing its flow direction; enters the lower space (6*b*) of the refrigerant outlet header section (6); and enters the upper space (6*a*) through the through holes (55A) and (55B) of the rear partition portion (49) of the partition plate (23).

Next, the refrigerant having entered the upper space (6*a*) of the refrigerant outlet header section (6) flows rightward, and flows out to the refrigerant outlet pipe (9) through the refrigerant outlet (78) of the rear cap (26*b*) of the right end member (26) and the refrigerant outflow port (84) of the joint plate (27).

While flowing through the refrigerant channels of the heat exchange tubes (15) of the front and rear heat exchange tube groups (16), the refrigerant is subjected to heat exchange with the air flowing through the air-passing clearances of the heat exchange core section (4), and flows out from the evaporator (1) in a vapor phase.

FIGS. 14 to 17 show modifications of the guide portion of the partition plate (23).

Figure 14:
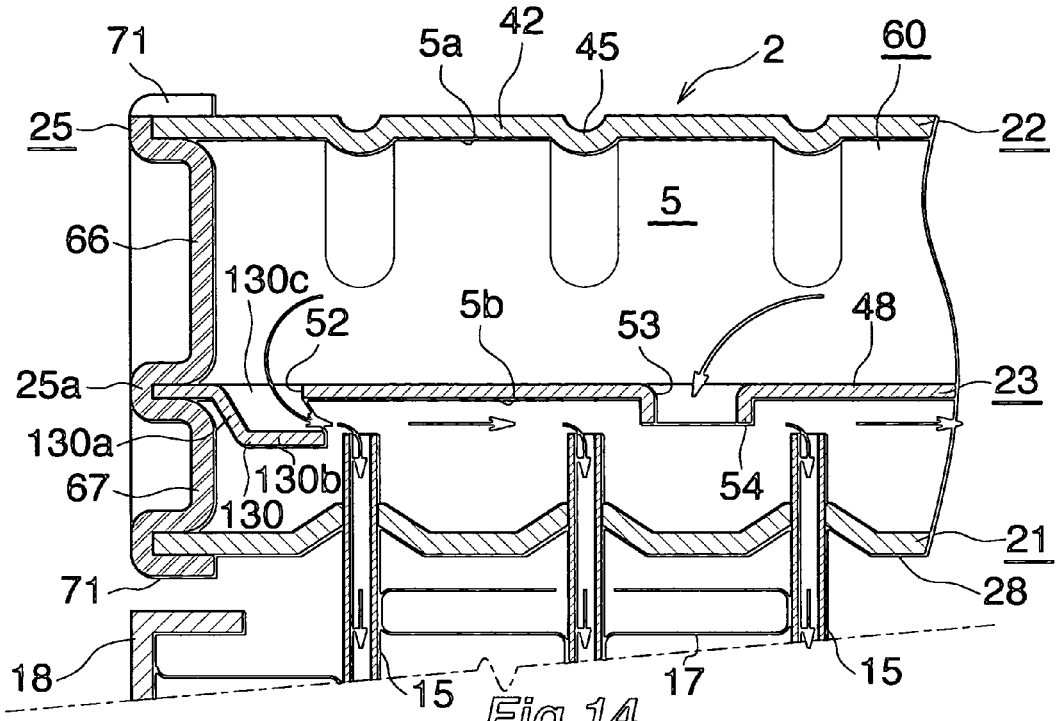
FIG. 14 is a view corresponding to FIG. 7 and showing a first modification of a guide portion of a front partition portion of a partition plate.

A guide portion (130) shown in FIG. 14 includes a guide slant portion (130*a*) which inclines downward (toward the side where the heat exchange tubes (15) are present) toward the right (the side where the refrigerant inlet (77) is present); a horizontal portion (130*b*) which extends rightward from the distal end of the slant portion (130*a*); and connection portions (130*c*) which are integrally formed at front and rear edges of the communication opening (52) of the front partition portion (48) such that they incline downward toward the inner side with respect to the front-rear direction, and connect front and rear edge portions of the slant portion (130*a*) and the horizontal portion (130*b*) to the front partition portion (48). The distal end (right end) of the horizontal portion (130*b*) of the guide portion (130) is located on the right side (the refrigerant inlet side) of the right edge of the communication opening (52) formed in the front partition portion (48) of the partition plate (23). Notably, the upper surface of the horizontal portion (130*b*) of the guide portion (130) is located at the same height as the upper ends of the heat exchange tubes (15).

Figure 15:
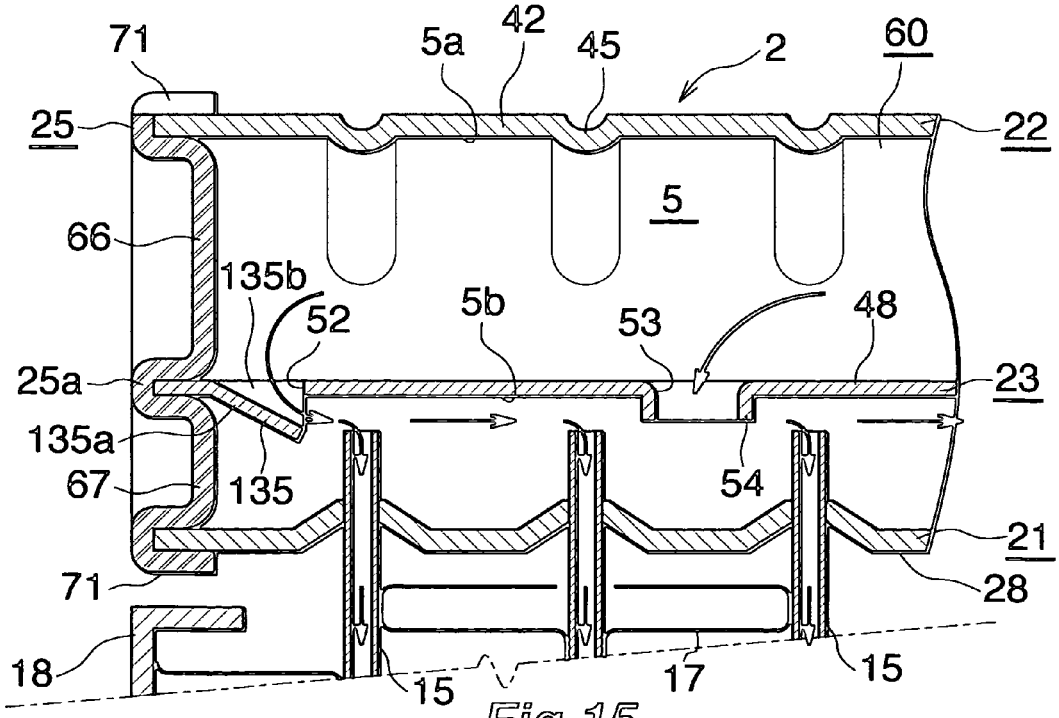
FIG. 15 is a view corresponding to FIG. 7 and showing a second modification of the guide portion of the front partition portion of the partition plate.

A guide portion (135) shown in FIG. 15 includes a guide slant portion (135*a*) which inclines downward (toward the side where the heat exchange tubes (15) are present) toward the right (the side where the refrigerant inlet (77) is present); and connection portions (135*c*) which are integrally formed at front and rear edges of the communication opening (52) of the front partition portion (48) such that they incline downward toward the inner side with respect to the front-rear direction, and connect front and rear edge portions of the slant portion (135*a*) to the front partition portion (48). The distal end (right end) of the slant portion (135*a*) of the guide portion (135) is generally located immediately under the right edge of the communication opening (52) formed in the front partition portion (48) of the partition plate (23).

Notably, although not shown in the drawings, the shapes of the guide portions (130) and (135) shown in FIGS. 14 and 15 as viewed from the right side are the same as the shape of the guide portion (59) of the above-described embodiment (see FIG. 8).

Figure 16:
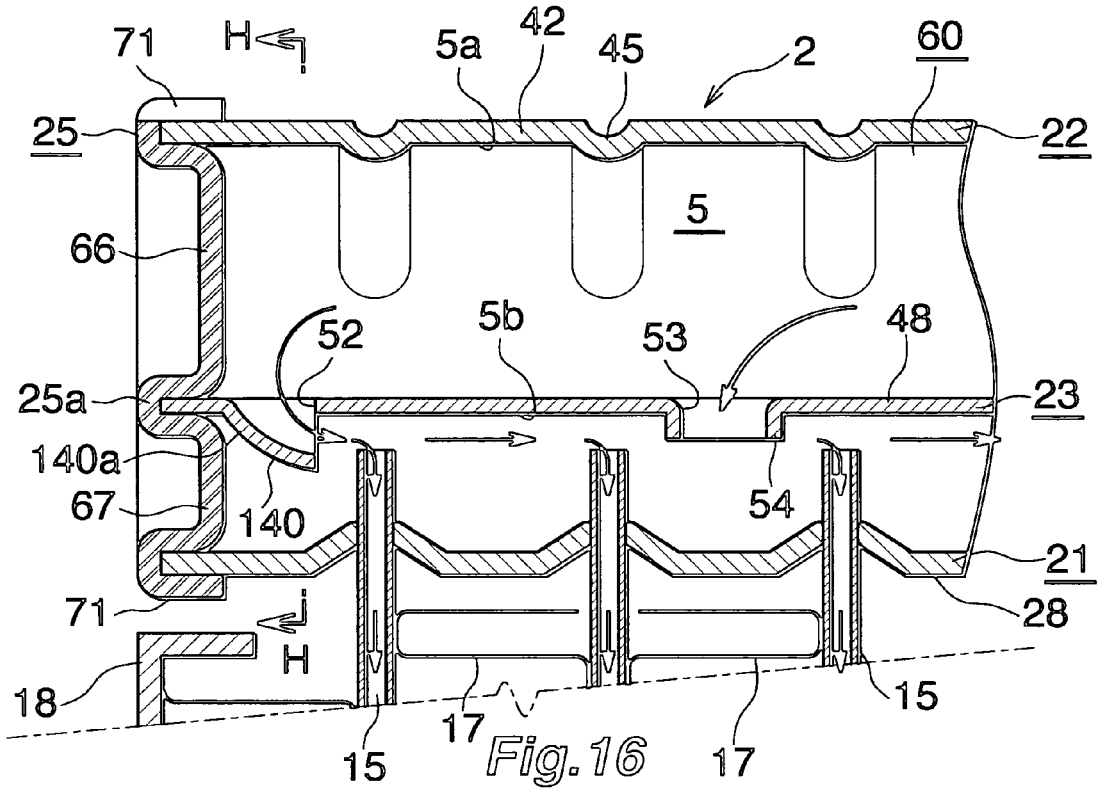
FIG. 16 is a view corresponding to FIG. 7 and showing a third modification of the guide portion of the front partition portion of the partition plate.
Figure 17:
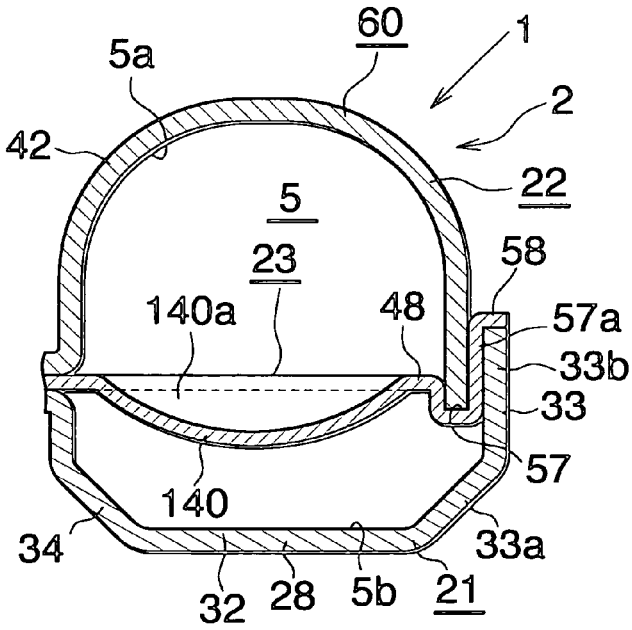
FIG. 17 is a cross sectional view taken along line H-H of FIG. 16.

A guide portion (140) shown in FIGS. 16 and 17 includes a guide curved portion (140*a*) which inclines downward (toward the side where the heat exchange tubes (15) are present) toward the right (the side where the refrigerant inlet (77) is present). When viewed from the right side, the shape of the curved portion (140*a*) assumes an arcuate shape such that a central portion with respect to the front-rear direction projects downward. The front and rear edge portions of the curved portion (140*a*) are connected to the front and rear edge portions of the communication opening (52) of the front partition portion (48).

In the above-described embodiment, the refrigerant inlet/outlet header tank (2) is located at the upper end, and the refrigerant turn header tank (3) is located at the lower end. However, in some cases, the refrigerant inlet/outlet header tank (2) is located at the lower end, and the refrigerant turn header tank (3) is located at the upper end, which arrangement is reverse to that in the embodiment. Further, in the above-described embodiment, one heat exchange tube group (16) is provided between the refrigerant inlet header section (5) and the first intermediate header tank section (11) of the header tanks (2) and (3) and another heat exchange tube group (16) is provided between the refrigerant outlet header section (6) and the second intermediate header tank section (12) of the header tanks (2) and (3). The arrangement of the heat exchange tube groups is not limited thereto. Two or more heat exchange tube groups (16) may be provided between the refrigerant inlet header section (5) and the first intermediate header tank section (11) of the header tanks (2) and (3) and between the refrigerant outlet header section (6) and the second intermediate header tank section (12) of the header tanks (2) and (3).

In the above-described embodiment, the heat exchanger of the present invention is applied to an evaporator of a car air conditioner using a chlorofluorocarbon-based refrigerant. However, the present invention is not limited thereto. The heat exchanger of the present invention may be used as an evaporator of a car air conditioner used in a vehicle, for example, an automobile, the car air conditioner including a compressor, a gas cooler (serving as a refrigerant cooler), an intermediate heat exchanger, an expansion valve, and an evaporator and using a supercritical refrigerant such as a $CO_2$ refrigerant.

What is claimed is:

1. A heat exchanger comprising a refrigerant inlet header section having a refrigerant inlet at a first end and closed at a second end opposite the first end; and a plurality of heat exchange tubes disposed at predetermined intervals along the longitudinal direction of the refrigerant inlet header section and connected to the refrigerant inlet header section, in which the interior of the refrigerant inlet header section is divided vertically into first and second spaces by means of a partition member, refrigerant flows into the first space via the refrigerant inlet, the heat exchange tubes project into the second space, the partition member has a communication opening located on the side toward the second end with respect to a heat exchange tube provided at an end portion of the partition member opposite the refrigerant inlet, the communication opening establishing communication between the first and second spaces, to thereby cause the refrigerant to flow from the first space into the second space via the communication opening while changing its flow direction to make a U-turn, wherein a guide portion is provided at an edge portion of the communication opening on the second end side, the guide portion projecting into the second space from a surface of the partition member facing the second space, and guiding the refrigerant to flow toward the first end side, and wherein the guide portion includes a slant portion which inclines toward the heat exchange tubes while approaching the first end, and a horizontal portion extending from a distal end of the slant portion toward the first end, and wherein the guide portion includes connection portions which are formed integrally with the partition member at opposite edge portions of the communication opening with respect to a direction of air flow such that the connection portions incline downward toward the inner side with respect to the direction of air flow, the connection portions connecting opposite edge portions, with respect to the direction of air flow, of the slant portion and the horizontal portion to the partition member.

2. A heat exchanger comprising a refrigerant inlet header section having a refrigerant inlet at a first end and closed at a second end opposite the first end; and a plurality of heat exchange tubes disposed at predetermined intervals along the longitudinal direction of the refrigerant inlet header section and connected to the refrigerant inlet header section, in which the interior of the refrigerant inlet header section is divided vertically into first and second spaces by means of a partition member, refrigerant flows into the first space via the refrigerant inlet, the heat exchange tubes project into the second space, the partition member has a communication opening located on the side toward the second end with respect to a heat exchange tube provided at an end portion of the partition member opposite the refrigerant inlet, the communication opening establishing communication between the first and second spaces, to thereby cause the refrigerant to flow from the first space into the second space via the communication opening while changing its flow direction to make a U-turn, wherein a guide portion is provided at an edge portion of the communication opening on the second end side, the guide portion projecting into the second space from a surface of the partition member facing the second space, and guiding the refrigerant to flow toward the first end side, and wherein the guide portion includes a slant portion which inclines toward the heat exchange tubes while approaching the first end, and wherein the guide portion includes connection portions which are formed integrally with the partition member at opposite edge portions of the communication opening with respect to a direction of air flow such that the connection portions incline downward toward the inner side with respect to the direction of air flow, the connection portions connecting opposite edge portions, with respect to the direction of air flow, of the slant portion to the partition member.

3. A heat exchanger comprising a refrigerant inlet header section having a refrigerant inlet at a first end and closed at a second end opposite the first end; and a plurality of heat exchange tubes disposed at predetermined intervals along the longitudinal direction of the refrigerant inlet header section and connected to the refrigerant inlet header section, in which the interior of the refrigerant inlet header section is divided vertically into first and second spaces by means of a partition member, refrigerant flows into the first space via the refrigerant inlet, the heat exchange tubes project into the second space the partition member has a communication opening located on the side toward the second end with respect to a heat exchange tube provided at an end portion of the partition member opposite the refrigerant inlet, the communication opening establishing communication between the first and second spaces, to thereby cause the refrigerant to flow from the first space into the second space via the communication opening while changing its flow direction to make a U-turn, wherein a guide portion is provided at an edge portion of the communication opening on the second end side, the guide portion projecting into the second space from a surface of the partition member facing the second space, and guiding the refrigerant to flow toward the first end side wherein the guide portion includes a curved portion which curves toward the heat exchange tubes while approaching the first end, and wherein the curved portion of the guide portion assumes an arcuate shape, when viewed from the refrigerant inlet side, such that a central portion with respect to the direction of air flow projects toward the heat exchange tubes, and opposite edge portions of the curved portion with respect to the direction of air flow are connected to opposite edge portions, with respect to the direction of air flow, of the communication opening of the partition member.

4. A heat exchanger comprising a refrigerant inlet header section having a refrigerant inlet at a first end and closed at a second end opposite the first end; and a plurality of heat exchange tubes disposed at predetermined intervals along the longitudinal direction of the refrigerant inlet header section and connected to the refrigerant inlet header section, in which the interior of the refrigerant inlet header section is divided vertically into first and second spaces by means of a partition member, refrigerant flows into the first space via the refrigerant inlet, the heat exchange tubes project into the second space, the partition member has a communication opening located on the side toward the second end with respect to a heat exchange tube provided at an end portion of the partition member opposite the refrigerant inlet, the communication opening establishing communication between the first and second spaces, to thereby cause the refrigerant to flow from the first space into the second space via the communication opening while changing its flow direction to make a U-turn, wherein a guide portion is provided at an edge portion of the communication opening on the second end side, the guide portion projecting into the second space from a surface of the partition member facing the second space, and guiding the refrigerant to flow toward the first end side, and wherein the refrigerant inlet header section includes an inlet-header-section main body which is opened at opposite ends thereof, and first and second caps which close the opened opposite ends of the inlet-header-section main body; the inlet-header-section main body includes a first member to which the heat exchange tubes are connected, and a second member joined to the first member and covering a side of the first member opposite the heat exchange tubes; the partition member is disposed between the first and second members and joined to the first and second members; and the refrigerant inlet is formed in a portion of the first cap on the first end side, the portion being located above the partition member, and wherein a refrigerant outlet header section is integrally provided on the upstream side of the refrigerant inlet header section with respect to the direction of air flow; the refrigerant outlet header section includes an outlet-header-section main body which is opened at opposite ends thereof, and first and second caps which close the opened opposite ends of the outlet-header-section main body; the outlet-header-section main body includes a first member to which the heat exchange tubes are connected, a second member joined to the first member and covering a side of the first member opposite the heat exchange tubes, and the partition member which is disposed between the first and second members so as to vertically divide the interior of the refrigerant outlet header section into first and second spaces; the partition member has a communication hole which establishes communication between the first and second spaces; the first member, the second member, and the partition member of the outlet-header-section main body are integrated with the first member, the second member, and the partition member of the inlet-header-section main body; the first and second caps of the refrigerant inlet header section are respectively integrated with the first and second caps of the refrigerant outlet header section; and the refrigerant inlet header section and the refrigerant outlet header section form a refrigerant inlet/outlet header tank.

5. A heat exchanger according to claim 4, wherein a refrigerant turn header tank is disposed such that the refrigerant turn header tank is separated from the refrigerant inlet/outlet header tank; a first intermediate header section facing the refrigerant inlet header section and a second header section facing the refrigerant outlet header section and communicating with the first intermediate header section are integrally provided in the refrigerant turn header tank; at least two heat exchange tube groups each composed of a plurality of heat exchange tubes whose opposite end portions are connected to the respective header sections of the two header tanks are arranged at an interval in the direction of air flow such that at least one heat exchange tube group is disposed between each header section of one header tank and the corresponding header section of the other header tank; the refrigerant turn header tank includes a first member to which the heat exchange tubes are connected, a second member joined to the first member and covering a side of the first member opposite the heat exchange tubes, and a the partition member which is disposed between the first and second members and joined to the first and second members so as to vertically divide the interiors of the first and second intermediate header sections into respective first and second spaces; and the partition member has communication holes which establish communication between the first and second spaces of the first intermediate header section and communication between the first and second spaces of the second intermediate header section.

6. A heat exchanger comprising a refrigerant inlet header section having a refrigerant inlet at a first end and closed at a second end opposite the first end; and a plurality of heat exchange tubes disposed intervals along the longitudinal direction of the refrigerant inlet header section and connected to the refrigerant inlet header section, in which the interior of the refrigerant inlet header section is divided vertically into first and second spaces by means of a partition member, refrigerant flows into the first space via the refrigerant inlet, the heat exchange tubes project into the second space, the partition member has a communication opening located on the side toward the second end with respect to a heat exchange tube provided at an end portion of the partition member opposite the refrigerant inlet, the communication opening establishing communication between the first and second spaces, to thereby cause the refrigerant to flow from the first space into the second space via the communication opening while changing its flow direction to make a U-turn, wherein a guide portion is provided at an edge portion of the communication opening on the second end side, the guide portion projecting into the second space from a surface of the partition member facing the second space, and guiding the refrigerant to flow toward the first end side, and wherein the distal end of the horizontal portion of the guide portion is located on the side toward the first end with respect to a first-end-side edge portion of the communication opening, and wherein the guide portion includes connection portions which are formed integrally with the partition member at opposite edge portions of the communication opening with respect to a direction of air flow such that the connection portions incline downward toward the inner side with respect to the direction of air flow, the connection portions connecting opposite edge portions, with respect to the direction of air flow, of the slant portion and the horizontal portion to the partition member.

7. A heat exchanger comprising a refrigerant inlet header section having a refrigerant inlet at a first end and closed at a second end opposite the first end; and a plurality of heat exchange tubes disposed at predetermined intervals along the longitudinal direction of the refrigerant inlet header section and connected to the refrigerant inlet header section, in which the interior of the refrigerant inlet header section is divided vertically into first and second spaces by means of a partition member, refrigerant flows into the first space via the refrigerant inlet, the heat exchange tubes project into the second space, the partition member has a communication opening located on the side toward the second end with respect to a heat exchange tube provided at an end portion of the partition member opposite the refrigerant inlet, the communication opening establishing communication between the first and second spaces, to thereby cause the refrigerant to flow from the first space into the second space via the communication opening while changing its flow direction to make a U-turn, wherein a guide portion is provided at an edge portion of the communication opening on the second end side, the guide portion projecting into the second space from a surface of the partition member facing the second space, and guiding the refrigerant to flow toward the first end side, and wherein the refrigerant inlet header section includes an inlet-header-section main body which is opened at opposite ends thereof, and first and second caps which close the opened opposite ends of the inlet-header-section main body; the inlet-header-section main body includes a first member to which the heat exchange tubes are connected, and a second member joined to the first member and covering a side of the first member opposite the heat exchange tubes; the partition member is disposed between the first and second members and joined to the first and second members; and the refrigerant inlet is formed in a portion of the first cap on the first end side, the portion being located above the partition member and wherein each of the caps has a first inward projecting portion to be fitted into the first space of the inlet-header-section main body and a second inward projecting portion to be fitted into the second space of the inlet-header-section main body; the refrigerant inlet is formed in a projecting end wall of the first inward projecting portion of the first cap; and opposite end portions of the partition member are fitted between the first and second inward projecting portions of the first and second caps and joined to the first and second caps, and wherein a refrigerant outlet header section is integrally provided on the upstream side of the refrigerant inlet header section with respect to the direction of air flow; the refrigerant outlet header section includes an outlet-header-section main body which is opened at opposite ends thereof, and first and second caps which close the opened opposite ends of the outlet-header-section main body; the outlet-header-section main body includes a first member to which the heat exchange tubes are connected, a second member joined to the first member and covering a side of the first member opposite the heat exchange tubes, and the partition member which is disposed between the first and second members so as to vertically divide the interior of the refrigerant outlet header section into first and second spaces; the partition member has a communication hole which establishes communication between the first and second spaces; the first member, the second member, and the partition member of the outlet-header-section main body are integrated with the first member, the second member, and the partition member of the inlet-header-section main body; the first and second caps of the refrigerant inlet header section are respectively integrated with the first and second caps of the refrigerant outlet header section; and the refrigerant inlet header section and the refrigerant outlet header section form a refrigerant inlet/outlet header tank.

8. A heat exchanger according to claim 7, wherein a refrigerant turn header tank is disposed such that the refrigerant turn header tank is separated from the refrigerant inlet/outlet header tank; a first intermediate header section facing the refrigerant inlet header section and a second header section facing the refrigerant outlet header section and communicating with the first intermediate header section are integrally provided in the refrigerant turn header tank; at least two heat exchange tube groups each composed of a plurality of heat exchange tubes whose opposite end portions are connected to the respective header sections of the two header tanks are arranged at an interval in the direction of air flow such that at least one heat exchange tube group is disposed between each header section of one header tank and the corresponding header section of the other header tank; the refrigerant turn header tank includes a first member to which the heat exchange tubes are connected, a second member joined to the first member and covering a side of the first member opposite the heat exchange tubes, and a the partition member which is disposed between the first and second members and joined to the first and second members so as to vertically divide the interiors of the first and second intermediate header sections into respective first and second spaces; and the partition member has communication holes which establish communication between the first and second spaces of the first intermediate header section and communication between the first and second spaces of the second intermediate header section.

* * * * *